US008011933B2

(12) United States Patent
Ito

(10) Patent No.: US 8,011,933 B2
(45) Date of Patent: Sep. 6, 2011

(54) SUBSTRATE CONNECTING CONNECTOR AND SEMICONDUCTOR DEVICE SOCKET, CABLE CONNECTOR, AND BOARD-TO-BOARD CONNECTOR HAVING SUBSTRATE CONNECTING CONNECTOR

(75) Inventor: Toshiyasu Ito, Tougane (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 12/751,715

(22) Filed: Mar. 31, 2010

(65) Prior Publication Data

US 2010/0297857 A1 Nov. 25, 2010

(30) Foreign Application Priority Data

May 22, 2009 (JP) ..... 2009-124485

(51) Int. Cl.
*H01R 12/00* (2006.01)

(52) U.S. Cl. ..... 439/65

(58) Field of Classification Search ..... 439/66, 439/591, 65, 91, 71

See application file for complete search history.

(56) References Cited

U.S. PATENT DOCUMENTS

| | | | | |
|---|---|---|---|---|
| 4,144,648 | A * | 3/1979 | Grovender | 439/71 |
| 4,519,659 | A * | 5/1985 | Shiino et al. | 439/591 |
| 5,127,837 | A | 7/1992 | Shah et al. | |
| 5,282,111 | A | 1/1994 | Hopfer | |
| 5,485,351 | A | 1/1996 | Hopfer et al. | |
| 5,761,036 | A | 6/1998 | Hopfer et al. | |
| 5,847,572 | A * | 12/1998 | Iwasaki et al. | 439/91 |
| 6,168,442 | B1 * | 1/2001 | Naoi | 439/91 |
| 6,433,410 | B2 | 8/2002 | Tanioka et al. | |
| 6,710,610 | B1 | 3/2004 | Tanaka et al. | |
| 6,929,484 | B2 * | 8/2005 | Weiss et al. | 439/66 |
| 7,267,559 | B2 * | 9/2007 | Hashitani et al. | 439/91 |
| 7,309,244 | B2 * | 12/2007 | Yamada et al. | 439/91 |
| 7,393,471 | B2 * | 7/2008 | Inoue et al. | 439/91 |
| 7,835,160 | B2 * | 11/2010 | Yamamoto et al. | 439/65 |
| 2006/0160383 | A1 * | 7/2006 | Yamada et al. | 439/86 |
| 2007/0178727 | A1 * | 8/2007 | Igarashi et al. | 439/91 |
| 2008/0014796 | A1 * | 1/2008 | Takegahara et al. | 439/591 |

FOREIGN PATENT DOCUMENTS

| | | |
|---|---|---|
| JP | 61-44380 | 12/1986 |
| JP | H5-48141 Y2 | 12/1993 |
| JP | 6-784 | 1/1994 |
| JP | 6-5263 | 1/1994 |
| JP | 2891539 | 2/1999 |
| JP | 2904193 | 3/1999 |
| JP | 3092191 | 7/2000 |
| JP | 3330532 | 7/2002 |
| JP | 3453526 | 7/2003 |
| JP | 2004-128156 | 4/2004 |
| JP | 3578708 | 7/2004 |
| JP | 3640268 | 1/2005 |
| JP | 3741927 | 11/2005 |
| JP | 4099137 | 3/2008 |
| WO | WO 97/13295 | 4/1997 |

* cited by examiner

*Primary Examiner* — Briggitte R Hammond
(74) *Attorney, Agent, or Firm* — Finnegan, Henderson, Farabow, Garrett & Dunner, LLP

(57) ABSTRACT

An electrode terminal supporting body fixed on a printed wiring board and an anisotropic conductive sheet which is positioned on the electrode terminal supporting body and on which a semiconductor device is placed are provided between first and second stiffening plates. The first and second stiffening plates are fastened by machine screws with the electrode terminal supporting body, the anisotropic conductive sheet, and the printed wiring board interposed therebetween.

8 Claims, 32 Drawing Sheets

SUBSTRATE CONNECTING CONNECTOR AND SEMICONDUCTOR DEVICE SOCKET, CABLE CONNECTOR, AND BOARD-TO-BOARD CONNECTOR HAVING SUBSTRATE CONNECTING CONNECTOR

This application claims the benefit of Japanese Patent Application No. 2009-124485, filed May 22, 2009, which is hereby incorporated by reference herein in its entirety.

BACKGROUND OF THE INVENTION

1. Field of the Invention

The present invention relates to a substrate connecting connector which comprises an anisotropic conductive sheet and electrically connects a printed wiring board to an electronic device mounted on top of the printed wiring board, and relates to a semiconductor device socket, a cable connector, and a board-to-board connector each having the substrate connecting connector.

2. Description of the Related Art

Semiconductor devices as electronic devices mounted on electronic equipment and the like are generally subjected to tests using semiconductor device sockets for removing latent defects before the semiconductor devices are mounted, or the semiconductor devices are generally mounted on electronic equipment with the semiconductor device sockets interposed therebetween. Such semiconductor device sockets used in the tests or mounting are generally referred to as IC sockets. The IC sockets are provided on printed wiring boards (test boards or mounting boards), for example, as shown in Japanese Patent No. 2,904,193.

In the case of a semiconductor device socket provided in a transmission path where a differential signal and the like are transmitted at communication rates in a comparatively high frequency range, for example, 10 Gbps or more, it is known that the IC socket's performance of transmitting signals in a comparatively high frequency range is enhanced by adjusting impedance matching in the IC socket to improve the performance of transmitting signals in a comparatively high frequency range and reducing the inductance of each contact terminal of the IC socket by minimizing the length between a contact point of a movable terminal portion and a proximal end of a soldered fixed terminal portion in the contact terminal. Meanwhile, there is a case where the proximal ends of the soldered fixed terminal portions of the contact terminals are fixed directly to contact pads of the printed wiring board. In this case, corrosion-resistant gold plating is provided on the contact pads of the print wiring board, but it is difficult to make a coating thickness of the gold plating partially thick in the contact pads. Accordingly, if the gold plating in the contact pads of the printed wiring board has comparatively small thickness, for example, the reliability in electrical connection and the durability may be poor in some cases.

To address these problems, as shown in Japanese Patent No. 2,904,193 and Japanese Patent Laid-open No. 2004-128156, a semiconductor device socket in which a semiconductor device provided in the semiconductor device socket is electrically connected to the printed wiring board through an anisotropic conductive sheet provided directly or indirectly on the printed wiring board, has been proposed. When the semiconductor device socket is provided with the anisotropic conductive sheet and the semiconductor device is electrically connected, the conductive portions formed in the anisotropic conductive sheet are pressed with predetermined pressure.

SUMMARY OF THE INVENTION

In the cases where the semiconductor device socket is provided with an anisotropic conductive sheet as shown in Japanese Patent Laid-open No. 2004-128156, for example, the printed wiring board is sometimes warped about 0.5% per unit length. For example, in the case of a 40 mm square printed wiring board, the warpage thereof is 0.2 mm. In this case, the proper displacement amount of the conductive portions of the anisotropic conductive sheet is 0.2 mm when predetermined pressure is applied to the anisotropic conductive sheet. The anisotropic conductive sheet provided directly on the printed wiring board also curves according to the warpage of the printed wiring board, and the conductive portions are accordingly tilted. Therefore, the conductive portions might not be displaced in the proper amount in some locations even if the conductive portions are pressed with the predetermined pressure. Consequently, the semiconductor device and the printed wiring board might not be electrically connected.

Moreover, as shown in FIG. 3 of Japanese Patent No. 2,904,193, in the case where end faces of the conductive portions of the anisotropic conductive sheet are brought into direct contact with the head portions of electrode terminals, if the head portions of the electrode terminals and the conductive portions of the anisotropic conductive sheet are displaced from each other with respect to their common central axes, the ends of the head portions of the metallic electrode terminals come into contact with the conductive portions made of rubber, thus causing rupture in the rubber conductive portions.

In view of the above-described mentioned problem, the present invention aims to provide a substrate connecting connector having an anisotropic conductive sheet and electrically connecting a printed wiring board to an electronic device mounted on top of the printed wiring board, a semiconductor device socket, a cable connector, and a board-to-board connector each having the substrate connecting connector. The substrate connecting connector can reliably connect the electronic device to the printed wiring board even if the printed wiring board is warped and thus prevent undesired damage on the conductive portions of the anisotropic conductive sheet.

To achieve the above-mentioned described object, a substrate connecting connector according to the present invention comprises: an electrode terminal supporting body which is provided on a printed wiring board electrically connected to an electronic device and has a plurality of electrode terminals fixed to respective conductive layers of the printed wiring board; an anisotropic conductive sheet which is positioned on the electrode terminal supporting body and has a plurality of conductive portions formed corresponding to the electrode terminals; a pressing member for pressing at least either one of the plurality of conductive portions of the anisotropic conductive sheet or the electrode terminals against the other while holding one; and a fixture which fixes the pressing member to the printed wiring board between which the electronic device, the electrode terminal supporting body, and the anisotropic conductive sheet are interposed. In the substrate connecting connector, a diameter of each head portions of the electrode terminals brought into contact with the conductive portions of the anisotropic conductive sheet is set to have a diameter larger than a diameter of each conductive portion of the anisotropic conductive sheet.

In addition, a semiconductor device socket according to the present invention comprises: an electrode terminal supporting body which is provided on a printed wiring board electrically connected to a semiconductor device and has a plurality of electrode terminals fixed to respective conductive layers of the printed wiring board; an anisotropic conductive sheet which is positioned on the electrode terminal supporting body and has a plurality of conductive portions formed corresponding to the electrode terminals; a pressing member for pressing at least either one of the plurality of conductive portions of the anisotropic conductive sheet or the electrode terminals against the other while holding one; and a fixture which fixes the pressing member to the printed wiring board between which the semiconductor device, the electrode terminal supporting body, and the anisotropic conductive sheet are interposed. In the semiconductor device socket, a diameter of each head portions of the electrode terminals brought into contact with the conductive portions of the anisotropic conductive sheet is set to have a diameter larger than a diameter of each conductive portion of the anisotropic conductive sheet.

Moreover, a cable connector according to the present invention comprises: an electrode terminal supporting body which is provided on a printed wiring board electrically connected to an end of a cable and has a plurality of electrode terminals fixed to respective conductive layers of the printed wiring board; an anisotropic conductive sheet which is positioned on the electrode terminal supporting body and has a plurality of conductive portions formed corresponding to the electrode terminals; a pressing member for pressing at least either one of the plurality of conductive portions of the anisotropic conductive sheet or the electrode terminals against the other while holding one; and a fixture which fixes the pressing member to the printed wiring board between which the end of the cable, the electrode terminal supporting body, and the anisotropic conductive sheet are interposed. In the cable connector, a diameter of each head portions of the electrode terminals brought into contact with the conductive portions of the anisotropic conductive sheet is set to have a diameter larger than a diameter of each conductive portion of the anisotropic conductive sheet.

Further, a board-to-board connector according to the present invention comprises: a first electrode terminal supporting body which is provided on a first printed wiring board and has a plurality of electrode terminals fixed to respective conductive layers of the first printed wiring board; a second electrode terminal supporting body which is provided on a second printed wiring board placed opposed to the first printed wiring board and has a plurality of electrode terminals fixed to respective conductive layers of the second printed wiring board; an anisotropic conductive sheet which is positioned between the first and second electrode terminal supporting bodies and has a plurality of conductive portions formed corresponding to the electrode terminals; a pair of pressing members for pressing at least either one of the plurality of conductive portions of the anisotropic conductive sheet or the electrode terminals against the other while holding one; and a fixture which fixes the pair of pressing members to the first and second printed wiring boards between which the first and second printed wiring boards, the first and second electrode terminal supporting bodies, and the anisotropic conductive sheet are interposed. In the board-to-board connector, a diameter of each head portions of the electrode terminals brought into contact with the conductive portions of the anisotropic conductive sheet is set to have a diameter larger than a diameter of each conductive portion of the anisotropic conductive sheet.

According to the substrate connecting connector of the present invention and the semiconductor device socket, cable connector, and board-to-board connector including the substrate connecting connector, even if the printed wiring board is warped, the warpage of the substrate is suppressed by the rigidity of the electrode terminal supporting body, thus ensuring electrical connection between the electronic device and the printed wiring board. Moreover, the diameter of the head portion of each of the electrode terminals brought into contact with the conductive portions of the anisotropic conductive sheet is set larger than the diameter of each conductive portion of the anisotropic conductive sheet. This can prevent undesired damage on the conductive portions of the anisotropic conductive sheet.

Further features of the present invention will become apparent from the following description of exemplary embodiments (with reference to the attached drawings).

DESCRIPTION OF THE EMBODIMENTS

Figure 2:
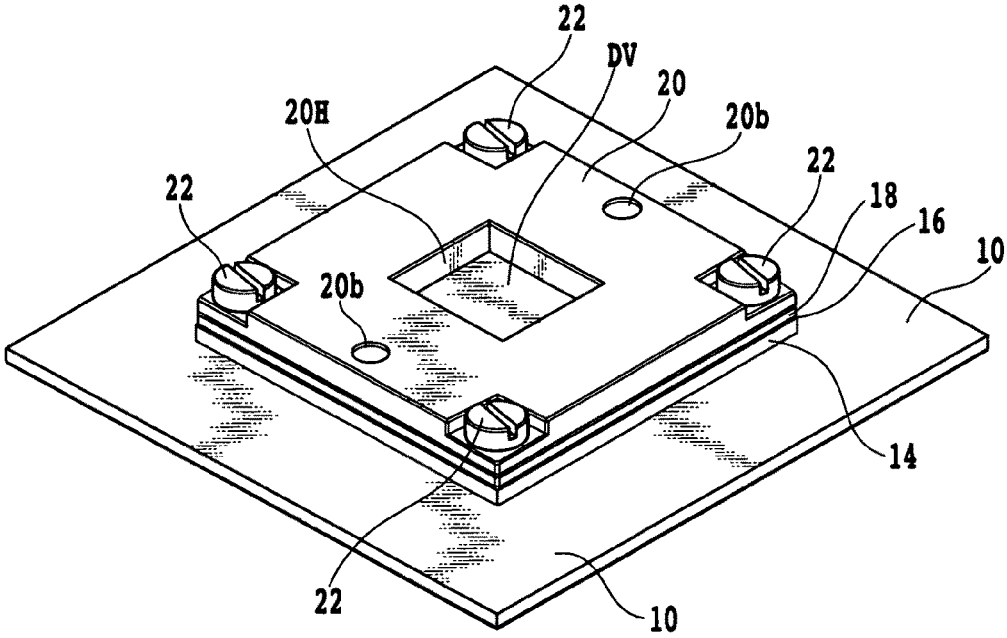
FIG. 2 is a perspective view showing an appearance of the embodiment of the semiconductor device socket according to the present invention together with a printed wiring board.

FIG. 2 shows an appearance of an embodiment of a semiconductor device socket to which an embodiment of a substrate connecting connector according to the present invention is applied.

In FIG. 2, the semiconductor device socket is placed on a printed wiring board 10. The printed wiring board 10 is made of, for example, glass epoxy resin and has an electrode group 10E in substantially the center of one of surfaces thereof (see FIG. 3). The electrode group 10E comprises electrode pads 10*ei* (i=1 to n, n is a positive integer) formed in a grid corresponding to positions of electrode terminals 24*ai* described later. Around the electrode group 10E, four holes 10*a* through which machine screws 22 are inserted are formed.

The semiconductor socket comprises an electrode terminal supporting body 14 provided on the printed wiring board 10 and has the electrode terminals 24*ai* (i=1 to n, n is a positive integer); an anisotropic conductive sheet 16 positioned and placed on the electrode terminal supporting body 14; a positioning plate 18 for positioning electrode portions of an attached semiconductor device DV to respective conductive portions of the later-described anisotropic conductive sheet 16, and first and second stiffening plates 20 and 12. The first and second stiffening plates 20 and 12 sandwich the attached semiconductor device DV, the positioning plate 18, anisotropic conductive sheet 16, the electrode terminal supporting body 14, and the printed wiring board 10 in cooperation with each other.

The semiconductor device DV is provided with an integrated circuit within a Land Grid Array (LGA) package, for example.

The anisotropic conductive sheet 16 comprises a conductive surface forming portion 16E consisting of a plurality of conductive portions 16Ea formed in a grid; and an insulating base material 16Eb formed around the conductive portions 16Ea and a frame material made of a metallic thin-plate material or a resin material surrounding the conductive surface forming portion 16E. The conductive portions 16Ea of the conductive surface forming portion 16E correspond to the flat electrode portions of the semiconductor device DV and electrode terminal portions of the later-described electrode terminal supporting body 14. The conductive portions 16Ea are made of a composite conductive material, for example, an anisotropic conductive rubber formed of silicon rubber and metallic particles. The anisotropic conductive rubber has conductivity in a thickness direction thereof but not in a direction along the surface thereof. Moreover, the anisotropic conductive rubber may be either one of a dispersion type in which the conductive portions 16Ea are dispersed in insulating rubber and an uneven distribution type in which a plurality of the conductive portions 16Ea are partially unevenly distributed. By making the conductive portions 16Ea of such anisotropic conductive rubber, the each electrode portions of the semiconductor device and the conductive portions Ea are allowed to be connected through surface contact. This causes contact failure and damage on the conductive portions resulting from contact with the electrode portions of the semiconductor device to be avoided. The conductive portions 16Ea may be made of insulating rubber and conductive filamentous material or fibers. The top ends of the conductive portions 16Ea are formed to have flat surfaces on the same plane as the surface of the insulating base material 16Eb. The insulating base material 16Eb is made of, for example, silicon rubber.

The top ends of the conductive portions 16Ea of the anisotropic conductive sheet 16 are not limited to the aforementioned example. As exaggerated and shown in FIG. 8B, the anisotropic conductive sheet 16 may be replaced with an anisotropic conductive sheet 16' comprising conductive portions 16'Ea whose top ends are formed so as to protrude a predetermined amount AH in the thickness direction from the surface of an insulating base material 16'Eb. Similarly to the anisotropic conductive sheet 16, the anisotropic conductive sheet 16' comprises a conductive surface forming portion 16'E consisting of the plurality of conductive portions 16'Ea formed in a grid and the insulating base material 16'Eb formed around the conductive portions 16'Ea and a frame member made of a resin material or a metallic thin-plate member surrounding the conductive surface forming portion 16'E. The conductive portions 16'Ea of the conductive surface forming portion 16'E correspond to the respective flat electrode portions of the semiconductor device DV and the electrode terminal portion of the electrode terminal supporting body 14 and are made of a composite conductive material, for example, anisotropic conductive rubber composed of silicone rubber and metallic particles.

The substantially square frame member has holes 16*a* at individual corners thereof, and the later-described machine screws 22 are inserted through the holes 16*a*. In the central part between the holes 16*a* on each side of a pair of opposing sides of the frame member, a hole 16*b* is formed, respectively. Positioning pins 14*b* of a later-described electrode terminal supporting plate 14 are configured to be inserted through the holes 16*b*.

The rectangular positioning plate 18 has the same outside dimensions as those of the aforementioned anisotropic conductive sheet 16 and has an opening 18H in which the semiconductor device DV is inserted in the center thereof.

At individual corners of a frame portion forming the periphery of the opening 18H, holes 18*a* are formed. The machine screws 22 are configured to be inserted through the holes 18*a*. At the center between the holes 18*a* on each side of a pair of opposing sides of the frame, a hole 18*b* is formed. The positioning pins 14*b* of the later-described electrode terminal supporting plate 14 are configured to be inserted through the holes 18*b*.

Figure 4:
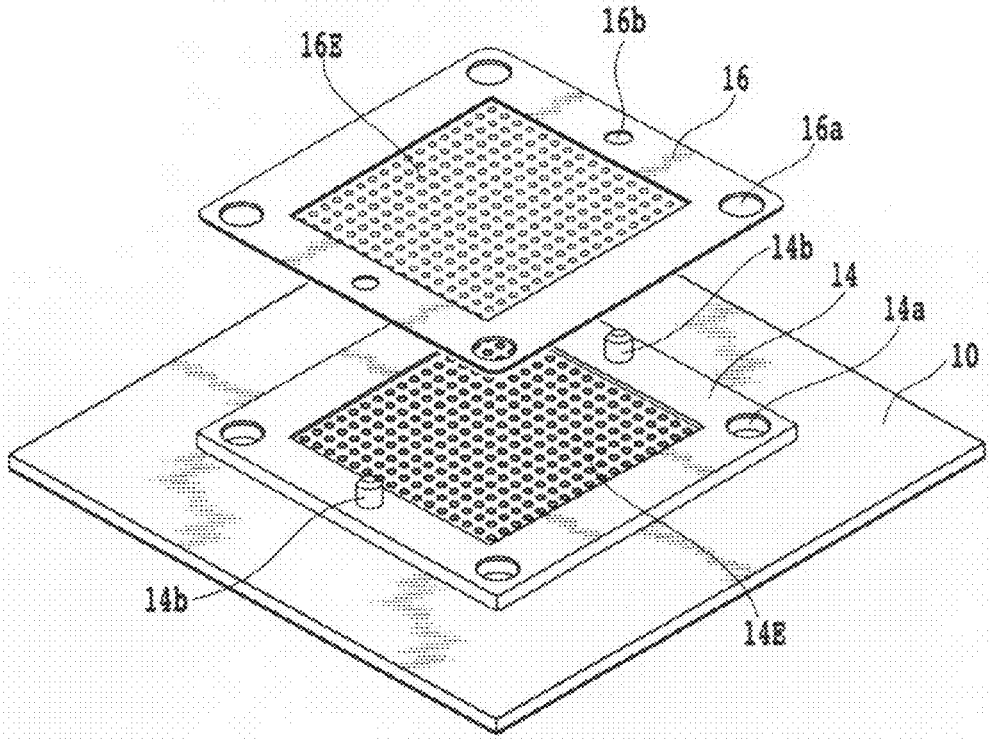
FIG. 4 is a perspective view made available for explaining an assembly in the embodiment shown in FIG. 2.

As enlarged in FIG. 4, the electrode terminal supporting body 14 comprises an electrode surface portion 14E in which a plurality of electrode terminals 24*ai* (i=1 to n, n is a positive integer) are arranged in a grid in the central part thereof (see FIG. 1) and a supporting body portion surrounding the electrode surface portion 14E.

Figure 9:
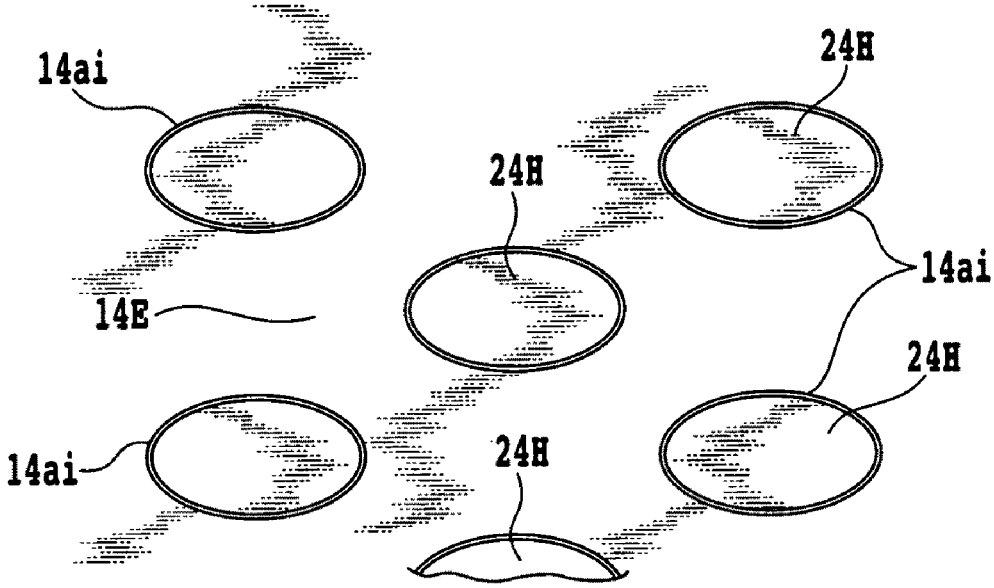
FIG. 9 is an enlarged perspective view showing apart of the surface of the electrode terminal supporting body and head portions of electrode terminals in the embodiment shown in FIG. 2.

The electrode terminals 24*ai* are formed by press forming of copper alloy, for example. Each of the electrode terminals 24*ai* comprises a disk-shaped head portion 24H fitted into corresponding one of the holes 14*ai* formed in a grid in the supporting body portion and a cylindrical portion 24B continued into the head portion 24H as enlarged in FIGS. 9 and 10B.

Figure 10A:
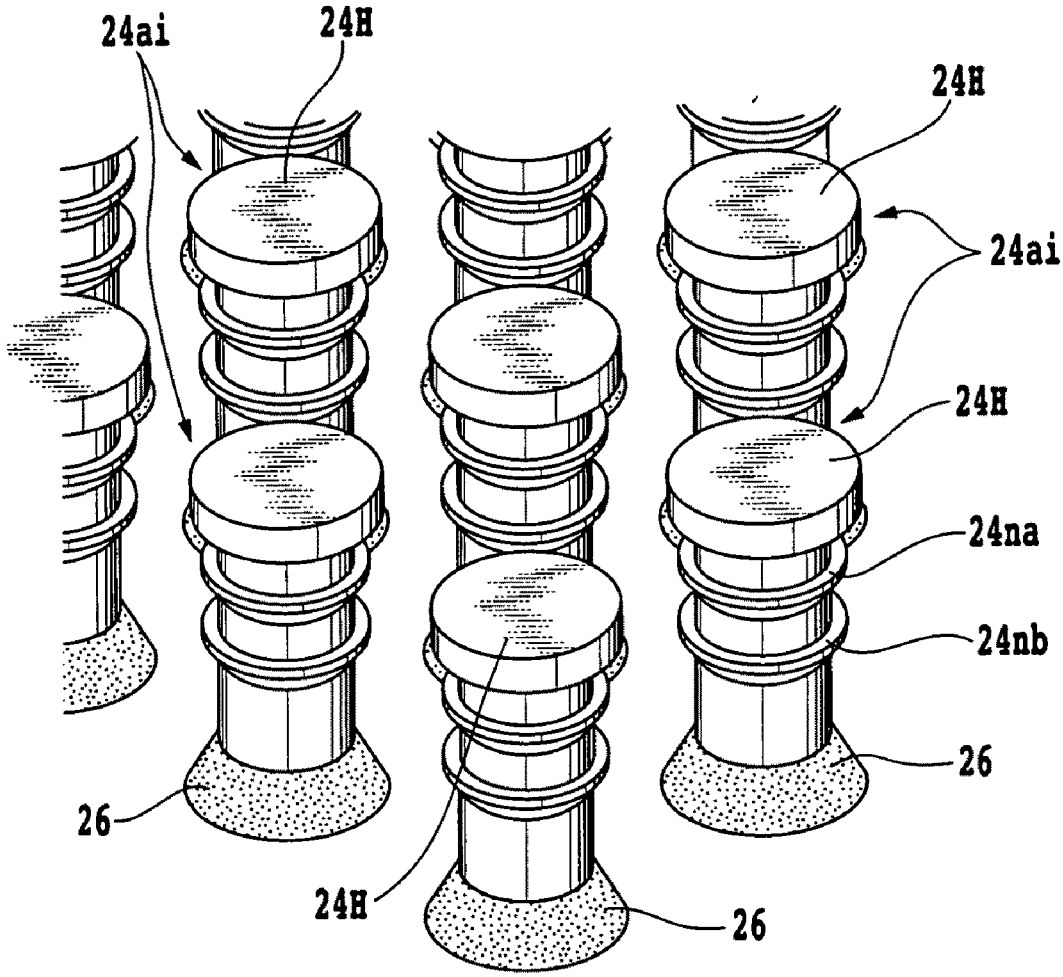
FIG. 10A is an enlarged perspective view showing a plurality of the electrode terminals in the embodiment shown in FIG. 2.

As partially enlarged in FIG. 10A, the electrode terminals 24*ai* are arranged in a grid at predetermined intervals. FIG. 10A is shown with the aforementioned supporting body portion removed.

Figure 8A:
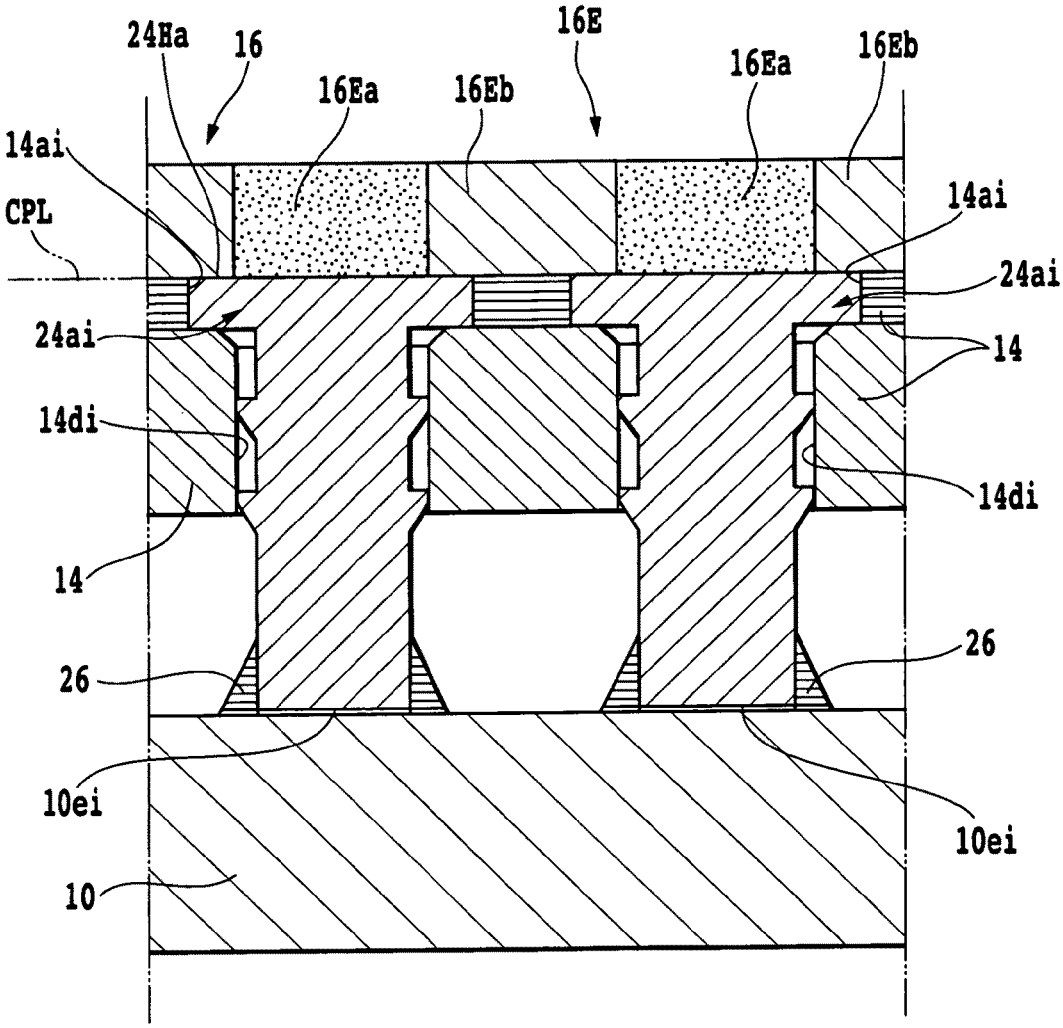
FIG. 8A is a partial enlarged cross-sectional view showing a part of the embodiment shown in FIG. 1.
Figure 10B:
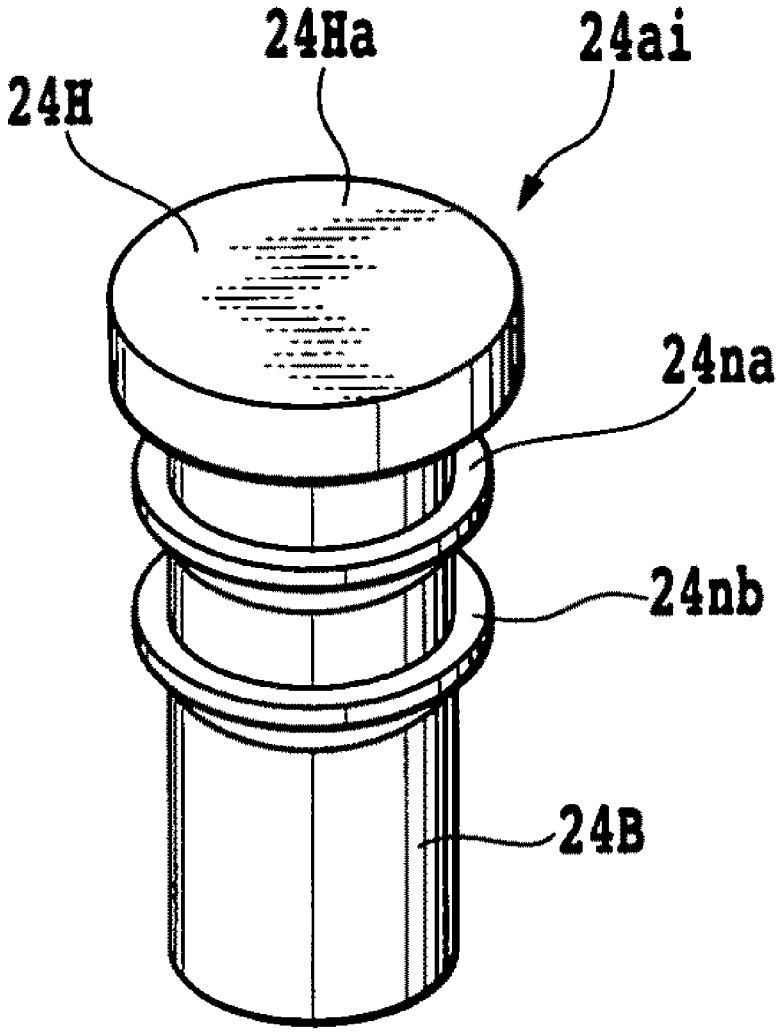
FIG. 10B is an enlarged perspective view showing one of the electrode terminals in the embodiment shown in FIG. 2.

As shown in FIG. 10B, the head portion 24H of each electrode terminal 24*ai* is provided with a flat touching surface 24Ha. The touching surface 24Ha touches on one of the conductive portions 16Ea of the aforementioned anisotropic conductive sheet 16 when the anisotropic conductive sheet 16 is placed on the electrode surface portion 14E of the electrode terminal supporting body 14. The flatness of the common plane including the plurality of touching surfaces 24Ha ranges for example, more than zero and not more than about ½ of the displacement of the conductive portions of the anisotropic conductive sheet. A difference between the maximum and minimum in height positions of the each touching surfaces 24Ha with respect to the common plane CPL is defined as the flatness as shown in FIG. 8A.

The diameter of each head portion 24H is set larger than the diameter of each conductive portion 16Ea of the aforementioned anisotropic conductive sheet 16. Even if the conductive portions 16Ea are misaligned with respect to the respective head portions 24H in a predetermined range, the conductive portions 16Ea of the anisotropic conductive sheet 16 are pressed against the touching surfaces 24Ha without becoming detached from each touching surfaces 24Ha. Therefore, there is not a fear of the damage of the touching surfaces 24Ha.

The inventor of this application found that when the diameter of the head portion 24H of each electrode terminal 24*ai* was set equal to or closer to that of each conductive portion 16Ea, the electrical characteristics (impedance matching) got better.

On the central part of the periphery of the cylindrical portion 24B, annular protrusions 24*na* and 24*nb* are formed at a predetermined distance. The protrusions 24*na* and 24*nb* are pressed and fixed into pores 14*di* (i=1 to n, n is a positive integer), which are continued into the holes 14*ai* of the later-described electrode terminal supporting body 14, to be latched (see FIG. 8A), respectively.

The bottom end of the cylindrical portion 24B is soldered and fixed to one of the electrode pads 10*ei* of the printed wiring board 10 by reflowing. As enlarged in FIG. 8A, at the bottom end of the cylindrical portion 24B, a solder fillet 26 is therefore formed.

The supporting body portion of the electrode terminal supporting body 14 is made of a resin material such as LCP, for example, and is substantially shaped in a square having the same outside dimensions as those of the aforementioned anisotropic conductive sheet 16. At corners of the rim of the supporting body portion surrounding the electrode surface portion 14E, the holes 14*a* are formed. The machine screws 22 are inserted through the holes 14*a*. Each of the positioning pins 14*b* is provided between the holes 14*a* provided on each of a pair of opposing sides of the rim. On the surface of the periphery of each holes 14*a* facing the printed wiring board 10, seating surfaces 14S (see FIG. 1) touching on the printed wiring board 10 are provided around the respective holes 14*a*. As enlarged in FIG. 8A, therefore, a gap corresponding to the height of the seating surfaces 14S are formed between the lower surface of the supporting body portion and the surface of the printed wiring board 10.

In an area where the electrode surface portion 14E is formed, the pores 14*di* communicating with the respective holes 14*ai* above are formed with their central axes coaxial with an axis of the individual holes 14*ai*. The diameter of each thin hole 14*di* is set smaller than that of each hole 14*ai*. Therefore the head portions 24H of the electrode terminals 24*ai* are preferably fixed at peripheral edges of the openings of the pores 14*di* in the respective holes 14*ai*. This allows the touching surfaces 24Ha of the head portions 24H of the electrode terminals 24*ai* and the flat electrode surface portion 14E formed in the periphery of the holes 14*ai* to be formed on the common plane. By arranging the touching surfaces 24Ha on the same plane as the electrode surface portion 14E, the conductive portions 16Ea touches on the electrode surface portion 14E provided on the same plane as the touching surfaces 24Ha even if the conductive portions 16Ea are misaligned with respect to the head portions 24H in a predetermined range. Accordingly, since there is not a fear of damage of the conductive portions 16Ea, the diameter of the head portion 24H of each electrode terminal 24*ai* can be therefore set equal to or close to the diameter of each conductive portion 16Ea. This can prevent the conductive portions 16Ea from being damaged and can also improve the electrical characteristic.

The pores 14*di* penetrate toward the printed wiring board 10. The holes 14*ai* adjacent to each other are separated by partition walls, and the pores 14*di* adjacent to each other are also separated by portions leading to the partition walls.

Figure 8B:
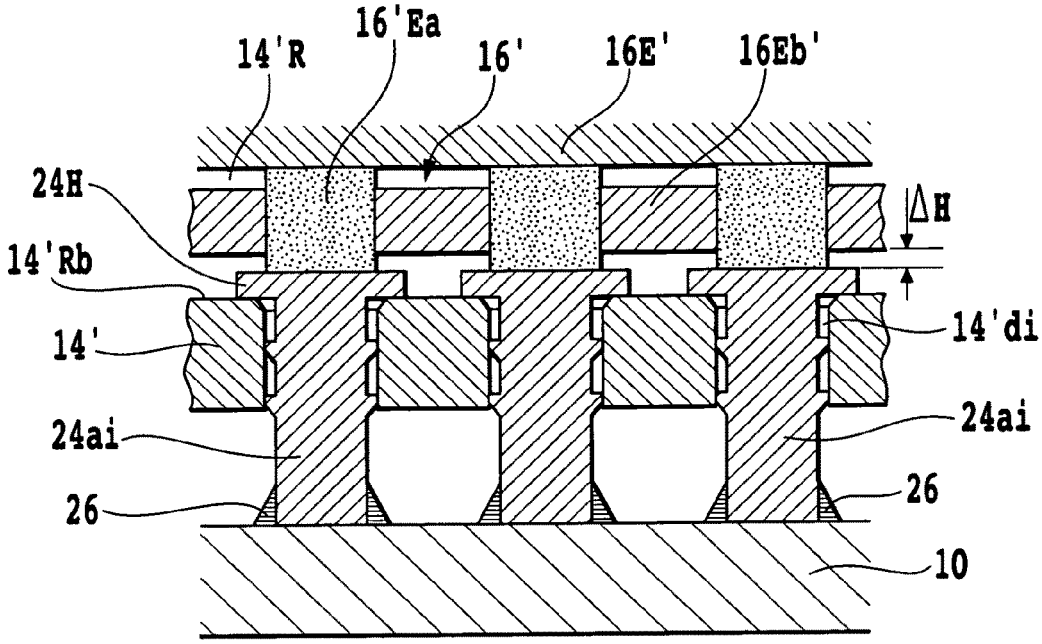
FIG. 8B is a partial cross-sectional view showing another example of an electrode terminal supporting body and an anisotropic conductive sheet.

It should be noted that the supporting body portion of the electrode terminal supporting body 14 is provided with the holes 14*ai* in a grid but is not limited to the example. For example, as shown in FIG. 8B, the electrode terminal supporting body 14 may be replaced with an electrode terminal supporting body 14' providing with pores 14'*di* (i=1 to n, n is a positive integer) in the bottom of a sheet placement portion 14'Rb in which the protrusions 24*na* and 24*nb* of the electrode terminals 24*ai* are individually pressed into the pores 14'*di* to be fixed. In FIG. 8B, the same constituent component as those shown in FIG. 8A are denoted by the same referential symbols or numerals, and the redundant description is omitted.

In the case of such a configuration, the head portions 24H of the electrode terminals 24*ai* protrudes from the bottom surface of the sheet placement portion 14'Rb. The head portions 24H of the electrode terminals 24*ai* adjacent to each other are placed at predetermined intervals within a gap between the anisotropic conductive sheet 16' and the bottom surface portion of the sheet placement portion 14'Rb.

The first stiffening plate 20 as a pressing member is formed into a square having outside dimensions the same as those of the positioning plate 18. The first stiffening plate 20 has flat surfaces opposed to each other and has the holes 20*a*, into which the machine screws 22 are inserted, at individual corners. In the central part between the holes 20*a* on the opposing sides, the holes 20*b* are formed. The aforementioned positioning pins 14*b* are inserted through the holes 20*b*. The first stiffening plate 20 is provided with a rectangular opening 20H which penetrates in the thickness direction and is provided in the central part thereof. Furthermore, the second stiffening plate 12 has flat surfaces opposed to each other and is provided with female thread holes 12*a* at individual corners. Into the internal thread holes 12*a*, the machine screws 22 are screwed through the above-described each holes of the first stiffening plate 20, the positioning plate 18, the anisotropic conductive sheet 16, the electrode terminal supporting body 14, and the printed wiring board 10.

In the embodiment of the semiconductor device socket according to the present invention, it should be noted that the two stiffening plates opposed to each other are provided but is not limited to the above embodiment. For example, when the printed wiring board is comparatively thick, the printed wiring board may be provided with female thread holes, and the second stiffening plate can be omitted.

Accordingly, an embodiment of the substrate connecting connector according to the present invention comprises the anisotropic conductive sheet 16, electrode terminal supporting body 14, the first stiffening plate 20, and machine screws 22 and female thread holes as fixtures.

Figure 7:
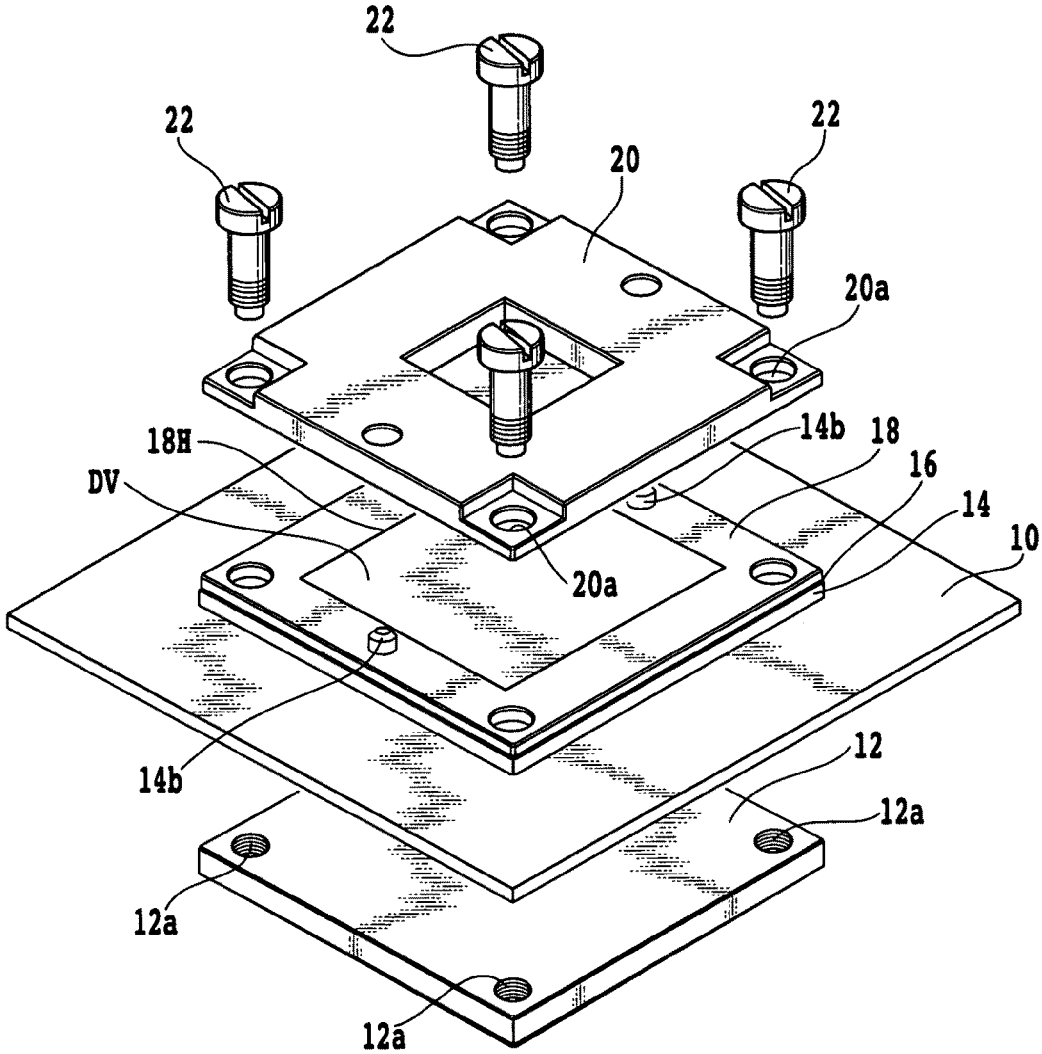
FIG. 7 is a perspective view made available for explaining the assembly in the embodiment shown in FIG. 2.

In such a configuration, in the case of assembling the semiconductor device socket and loading the semiconductor device DV into the inside thereof, as shown in FIG. 4, first, the electrode terminals 24*ai* of the electrode terminal supporting body 14 are fixed to the electrode pads 10*ei* of the printed wiring board 10 by reflow soldering. At that time, the electrode terminal supporting body 14 is placed on the printed wiring board 10 so that the holes 14*a* may correspond to the respective holes 10*a*. The printed wiring board 10 is placed on the second stiffening plate 12 so that the holes 10*a* are aligned with the respective internal thread holes 12*a* as shown in FIG. 7.

Figure 1:
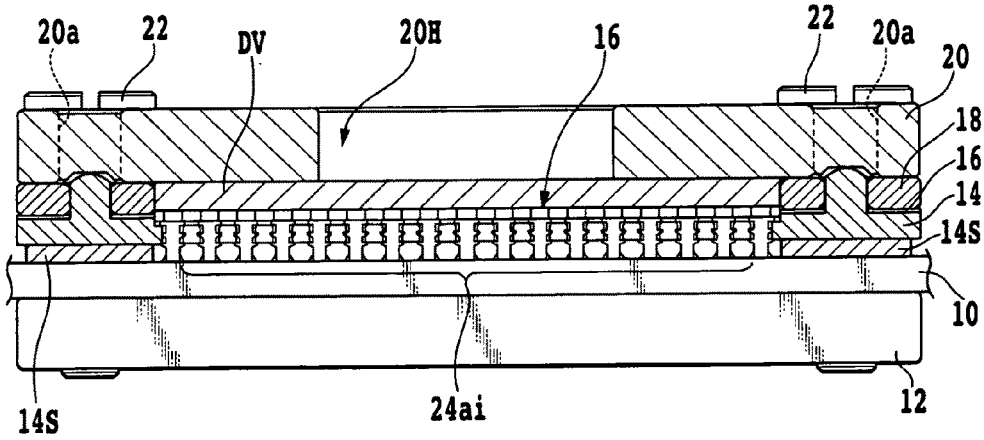
FIG. 1 is a partial cross-sectional view showing the configuration of an embodiment of a semiconductor device socket according to the present invention.
Figure 5:
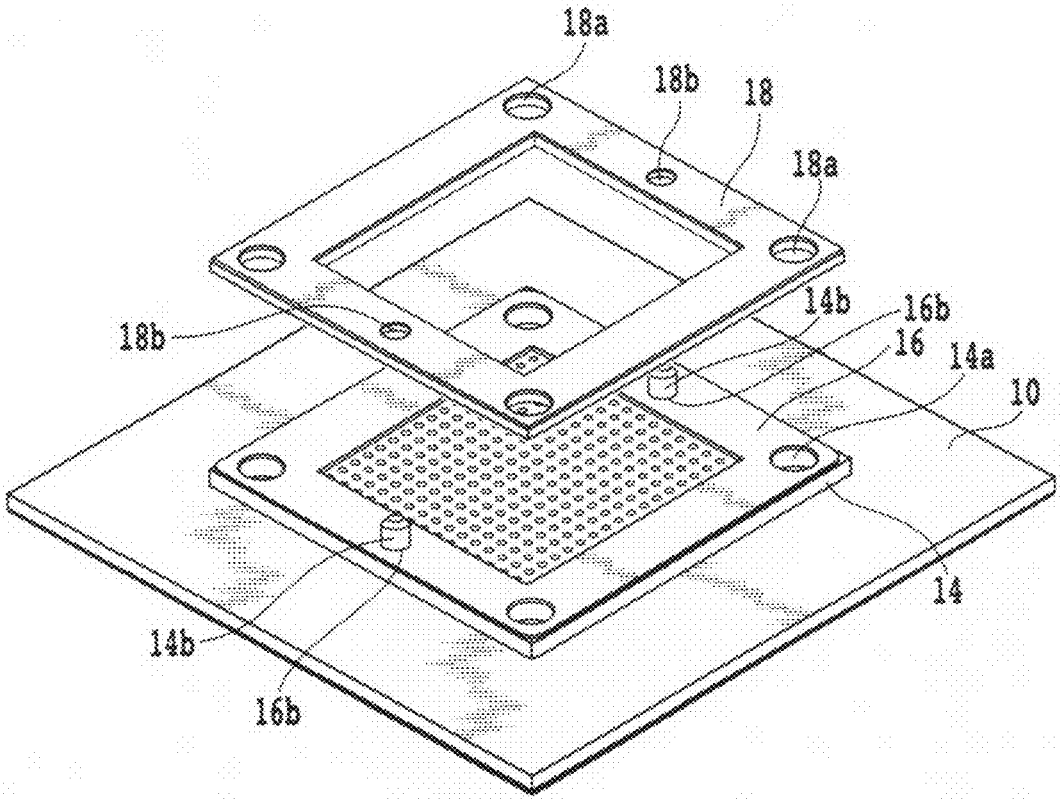
FIG. 5 is a perspective view made available for explaining the assembly in the embodiment shown in FIG. 2.

Next, as shown in FIG. 5, the anisotropic conductive sheet 16 is placed on the electrode terminal supporting body 14 so that the positioning pins 14*b* are fitted in the holes 16*b*. Therefore, the conductive portions 16Ea of the anisotropic conductive sheet 16 are positioned with respect to the head portions 24H of the electrode terminals 24*ai* of the electrode terminal supporting body 14. At that time, since the electrode terminal supporting body 14 is fixed to the printed wiring board 10 to form the flat electrode surface portion 14E as shown in FIG. 1, even if the printed wiring board 10 is curved, there is not a fear of the curvature of the anisotropic conductive sheet 16.

Figure 6:
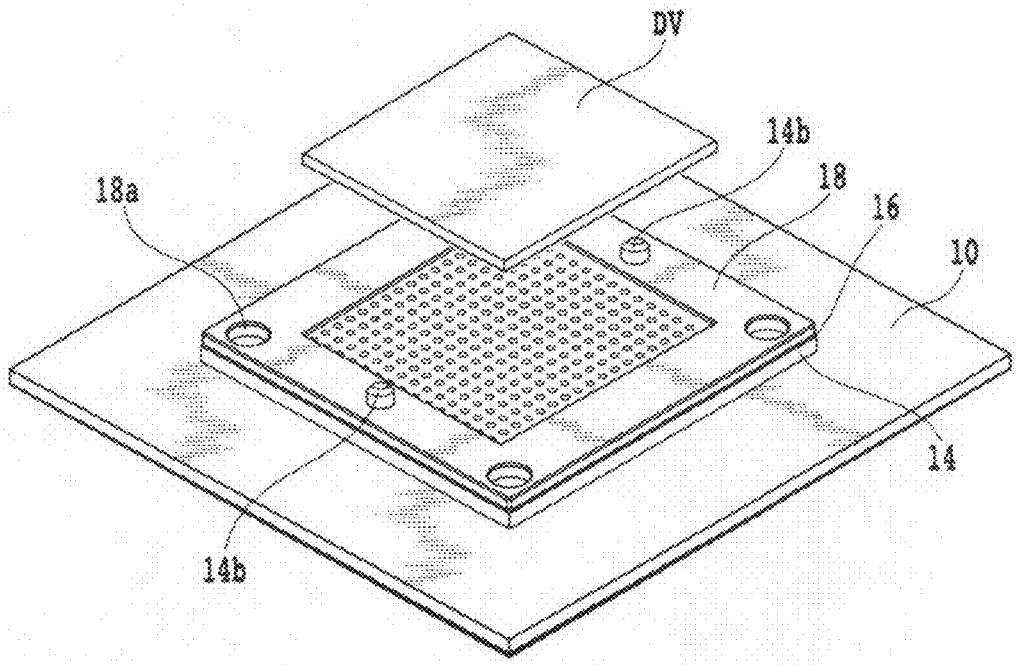
FIG. 6 is a perspective view made available for explaining the assembly in the embodiment shown in FIG. 2.

Subsequently, as shown in FIG. 6, the positioning plate 18 is placed on the anisotropic conductive sheet 16 so that the positioning pins 14*b* may be fitted in the holes 18*b*. This allows the holes 18*a* to be aligned with the holes 16*a*. As shown in FIGS. 6 and 7, the semiconductor device DV is then inserted into the opening portion 18H of the positioning plate 18. This causes the peripheral portion of the semiconductor device DV to be fitted into the inner peripheral surface forming the opening portion 18H with a predetermined gap therebetween. The electrode portions of the semiconductor device DV is thus positioned with respect to the conductive portions 16Ea of the anisotropic conductive sheet 16.

After the first stiffening plate 20 is placed on the positioning plate 18 into which the semiconductor device DV is loaded, the first stiffening plate 20 is fastened to the aforementioned positioning plate 18, anisotropic conductive sheet 16, electrode terminal supporting body 14, printed wiring board 10, and second stiffening plate 12 with the four machine screws 22. At that time, by the pressing surface of the first stiffening plate 20, the electrode portions of the semiconductor device DV are pressed against the conductive portions 16Ea of the anisotropic conductive sheet 16 by a predetermined amount. The electrode portions of the semiconductor device DV are thus electrically connected to the electrode pads 10*ei* of the printed wiring board 10 through the electrode terminal supporting body 14.

On the other hand, in case of detaching the semiconductor device DV, the four machine screws 22 are removed from the internal thread holes 12*a* of the second stiffening plate 12. The first stiffening plate 20 is then separated from the positioning plate 18, and the semiconductor device DV is taken out from the opening portion 18H of the positioning plate 18.

Figure 11:
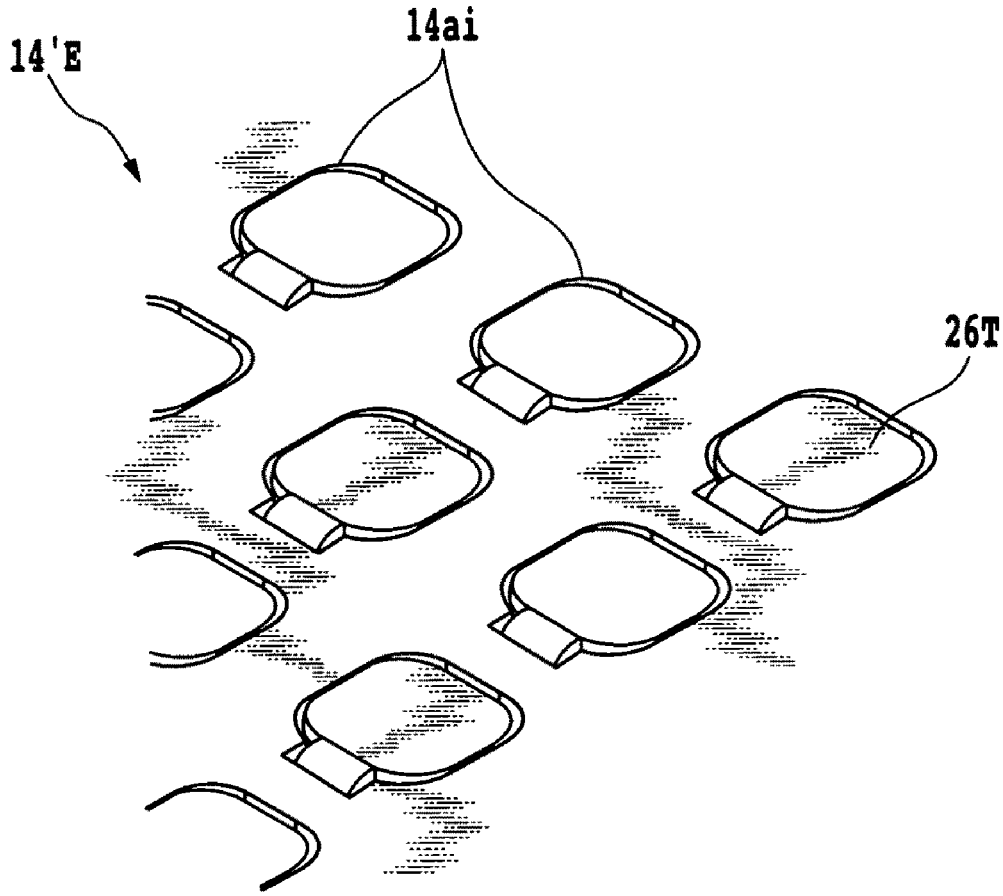
FIG. 11 is an enlarged perspective view showing a part of another example of the electrode terminal supporting body and the electrode terminals used in the embodiment of the semiconductor device socket according to the present invention.

FIG. 11 shows a part of the electrode surface portion 14'E of another example of the electrode terminal supporting body used in the embodiment of the substrate connecting connector according to the present invention. In FIG. 11, a plurality of holes 14'*ai* are formed in a grid at predetermined intervals in the electrode surface portion 14'E. Instead of the substantially cylindrical electrode terminals 24*ai* as described above, touching surface portions 26T of solder-ball-attached contact terminals 26*ai* (i=1 to n, n is a positive integer) are inserted into the respective holes 14'*ai* The gap between the outer periphery of the touching surface portion 26T and the inner periphery of the holes 14'*ai* is, for example, from 0.1 mm to 0.2 mm inclusive. The touching surface portions 26T individually constitute a part of the common flat electrode surface portion 14'E.

Figure 12:
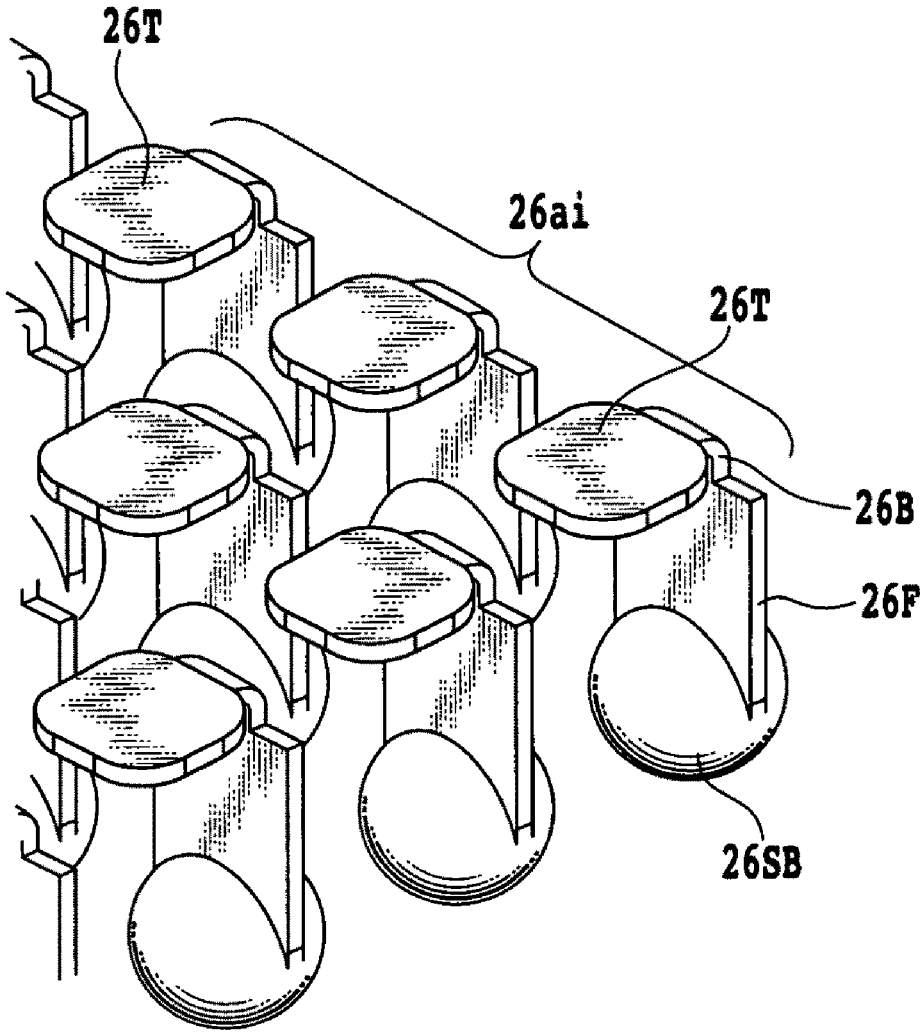
FIG. 12 is a perspective view showing a plurality of the electrode terminals in the example shown in FIG. 11.
Figure 13:
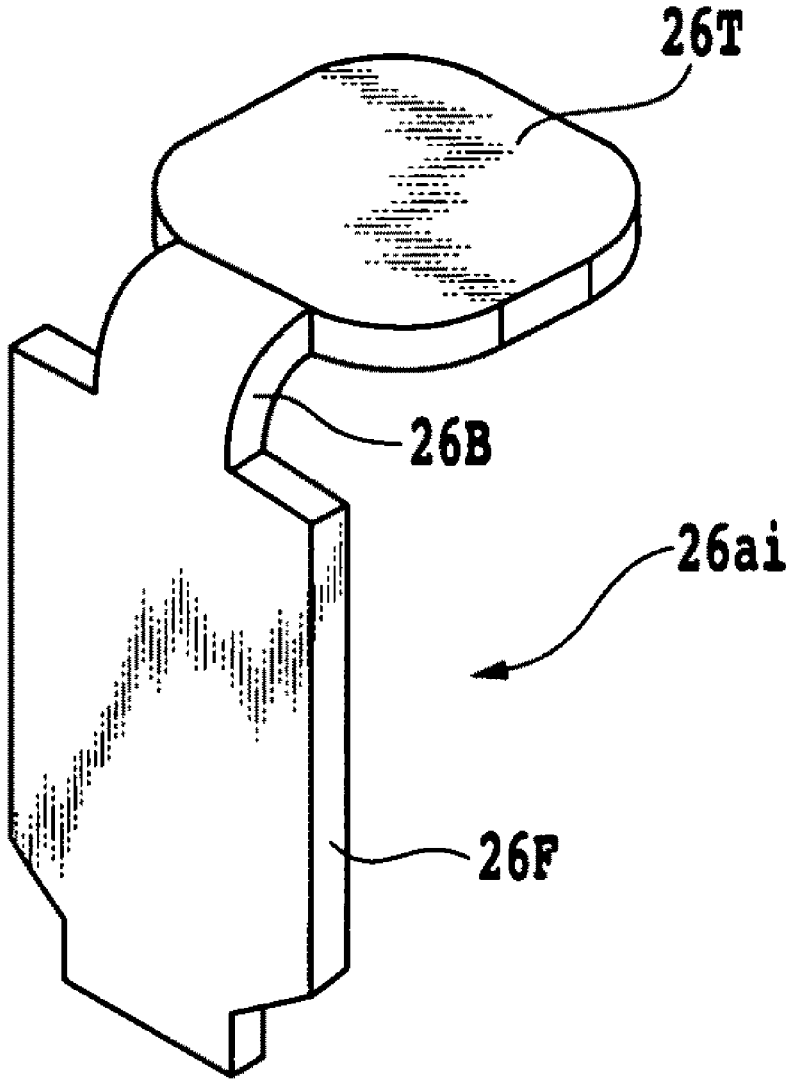
FIG. 13 is a perspective view showing one of the electrode terminals of the example shown in FIG. 11 with the solder ball removed.

As shown in FIGS. 12 and 13, each solder-ball-attached contact terminal 26*ai* is made of a metallic thin-plate material by presswork. Each of the solder-ball-attached contact terminal 26*ai* comprises the touching surface portion 26T, a solder ball 26SB which is welded to one of the electrode pads 10*ei*, and a fixed portion 26F. The touching surface portion 26T is configured to touch on and receives one of the conductive portions 16Ea of the aforementioned anisotropic conductive sheet 16. The fixed portion 26F has an end connected to the touching surface portion 26T with a bent portion 26B interposed therebetween while the other end thereof is connected to the solder ball 26SB. The surface area of the touching surface portion 26T is set larger than the cross-sectional area of each conductive portion 16Ea. The fixed portion 26F is pressed into a fixed groove formed within the electrode terminal supporting body not shown in the drawing.

Figure 15:
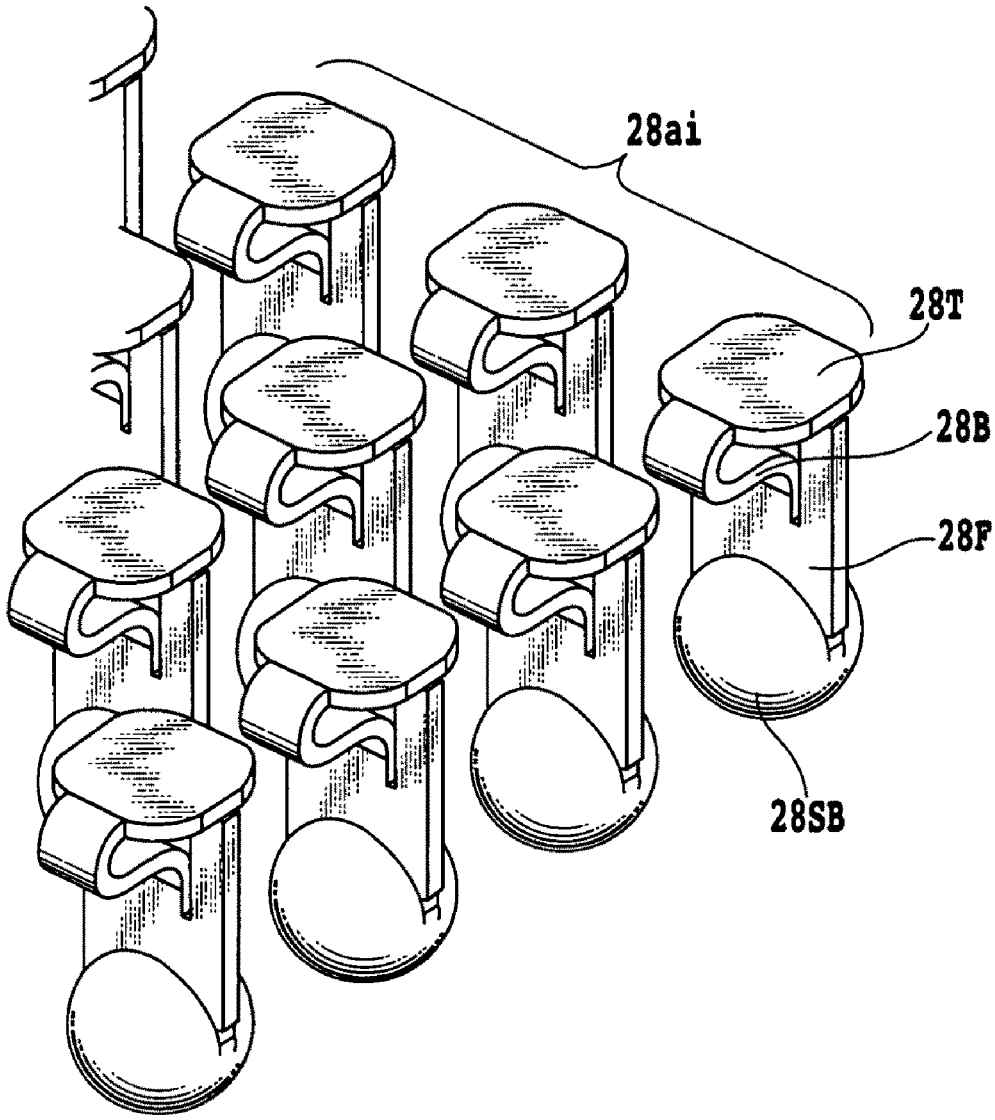
FIG. 15 is a perspective view showing the plurality of electrode terminals in the example shown in FIG. 14.

The solder-ball-attached contact terminals 26*ai* are not limited to the aforementioned example, and may be, for example, replaced with solder-ball-attached contact terminals 28*ai* as shown in FIG. 15.

Figure 14:
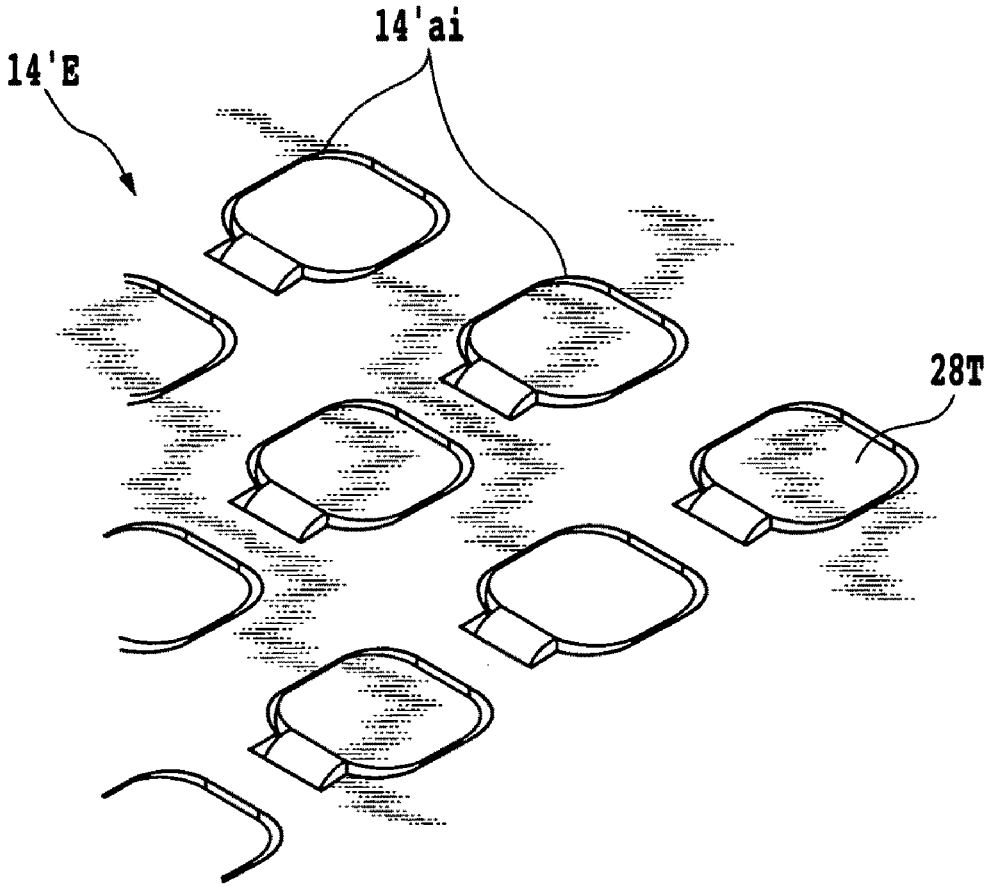
FIG. 14 is a perspective view showing still another example of the electrode terminal supporting body and the electrode terminals used in the embodiment of the semiconductor device socket according to the present invention.

In this example, as shown in FIG. 14, touching surface portions 28T of the solder-ball-attached contact terminals 28*ai* (n=1 to n, n is a positive integer) are inserted through the respective holes 14'*ai*. The touching surface portions 28T constitute a part of the same flat electrode surface portion 14'E.

Figure 16:
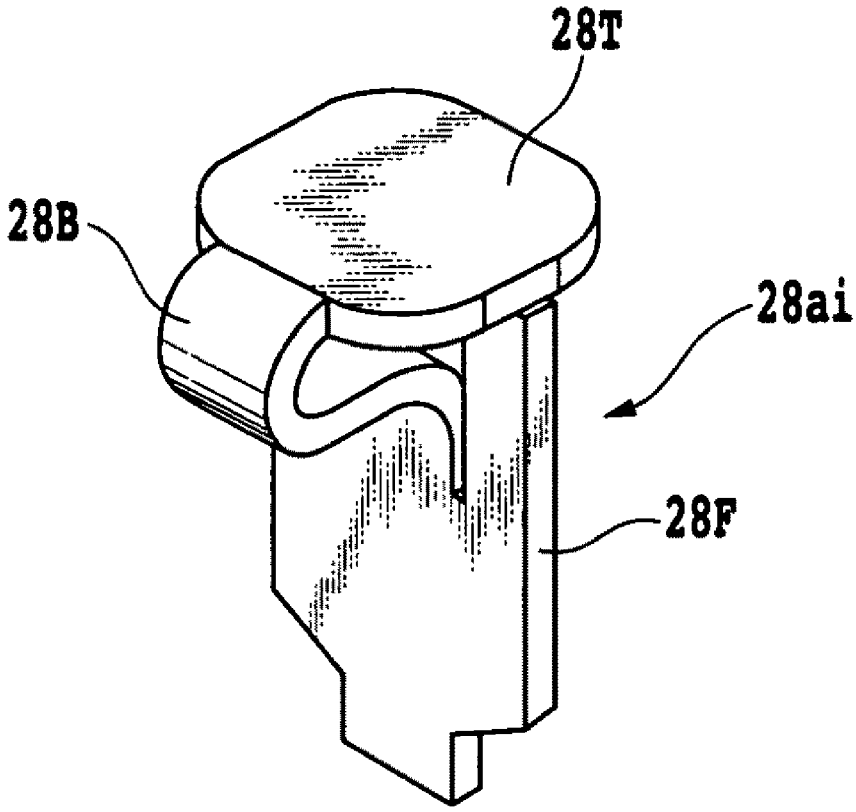
FIG. 16 is a perspective view showing one of the electrode terminals of the example shown in FIG. 14 with the solder ball removed.
Figure 17:
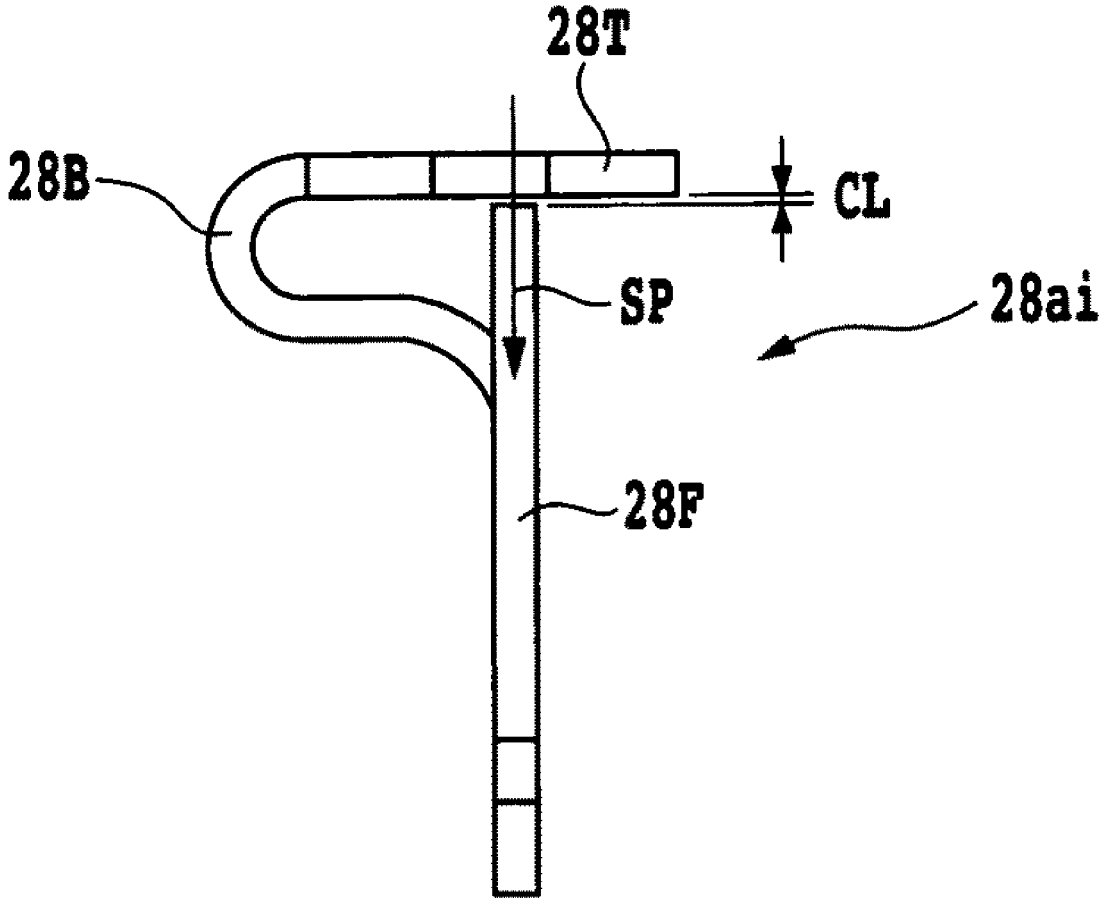
FIG. 17 is a side view of FIG. 16.

Each of the solder-ball-attached contact terminals 28*ai* is made of a metallic thin-plate material by presswork, for example. As shown in FIGS. 15 to 17, each solder ball-attached contact terminal 28*ai* comprises the touching surface portion 28T, a solder ball 28SB which is welded to one of the electrode pads 10*ei* of the aforementioned printed wiring board 10, and a fixed portion 28F. The touching surface portion 28T is configured to touch on and receive one of the conductive portions Ea of the aforementioned anisotropic conductive sheet 16. The fixed portion 28F has an end connected to the touching surface portion 28T with a bent portion 28B interposed therebetween while the other end thereof is connected to the solder ball 28SB. The surface area of the touching surface portion 28T is set larger than the cross-sectional area of each conductive portion 16Ea. The flatness of the same plane including the plurality of touching surface portions 28T ranges, for example, more than zero and not more than about ½ of the displacement of the conductive portions of the anisotropic conductive sheet. Similarly to the example shown in FIG. 8A above-described, a difference between the maximum and minimum in height positions of the individual touching surface portions 28T with respect to the same plane is defined as the flatness. A predetermined clearance CL is formed between one end of the fixed portion 28F near the touching surface portion 28T and the rear surface of the touching surface portion 28T. The touching surface portion 28T is connected through the bent portion 28B and therefore can elastically move within the predetermined clearance CL. The fixed portion 28F is pressed into a fixed groove formed within the electrode terminal supporting body not shown in the drawing.

When the touching surface portion 28T is pressed through one of the conductive portions 16Ea, the rear surface of the touching surface portion 28T comes into a contact with the end of the fixed portion 28F, and a signal flows in a direction indicated by an arrow SP in FIG. 17. The signal path between the anisotropic conductive sheet 16 and the printed wiring board 10 is shortened compared to the case where the signal flows through the bent portion 28B.

Figure 29:
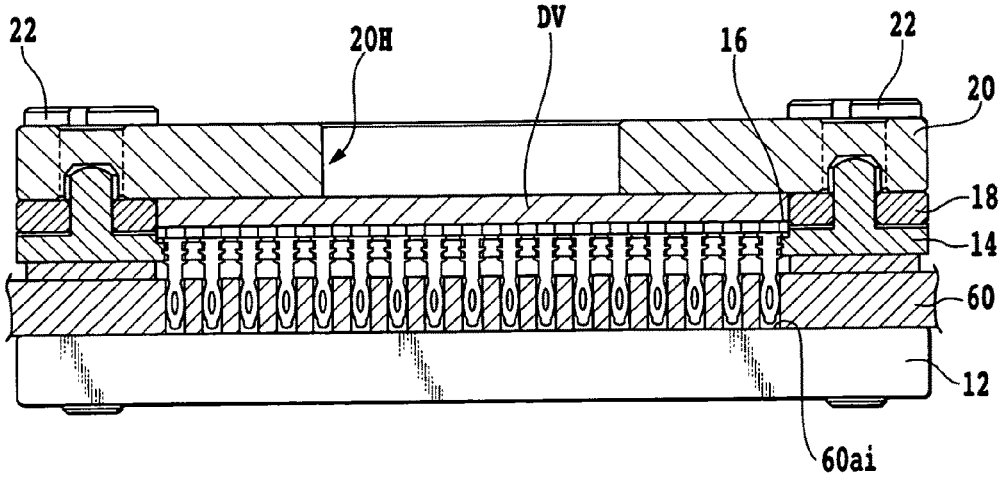
FIG. 29 is a partial cross-sectional view showing a variation of the semiconductor device socket according to the present invention.
Figure 30:
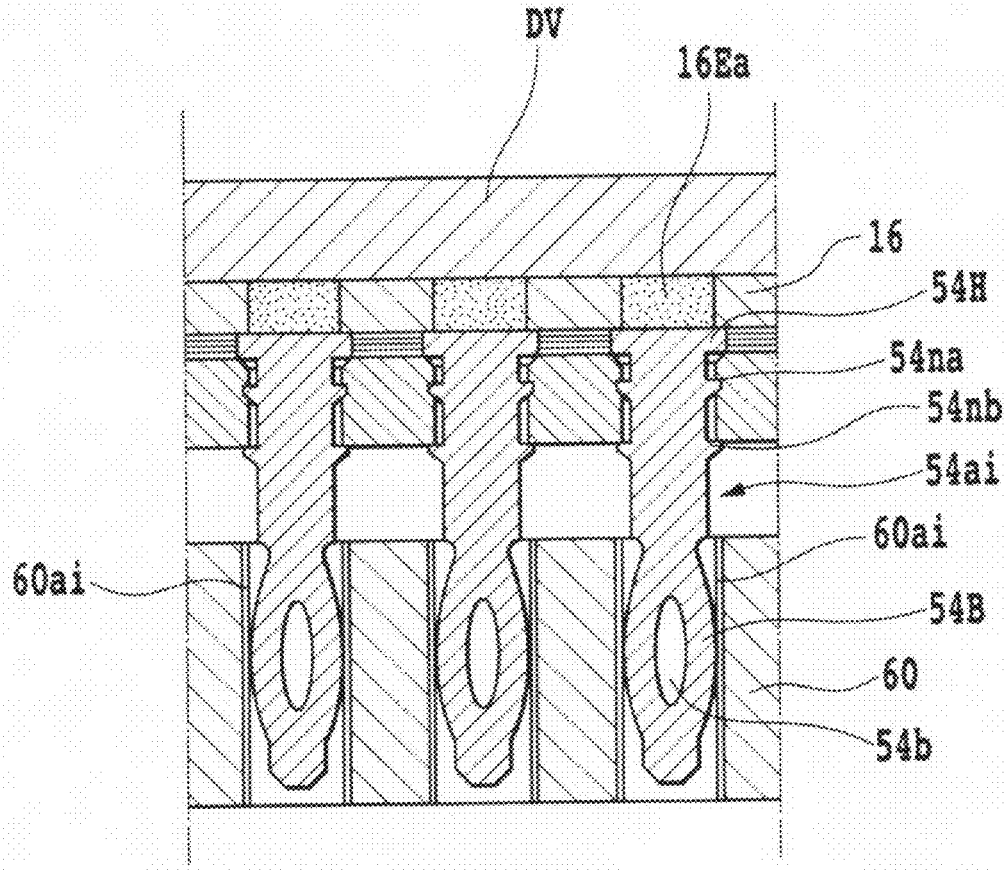
FIG. 30 is a partial enlarged cross-sectional view showing a part of the example shown in FIG. 29.

In the aforementioned example, the printed wiring board 10 includes the electrode pads 10*ei* on one of the surfaces. The printed wiring board 10 is not limited to the example and may be replaced with a printed wiring board 60 including plated through-holes 60*ai* (i=1 to n, i is a positive integer) as enlarged in FIGS. 29 and 30. In FIGS. 29 and 30, the same constituent components as those of the embodiment shown in FIG. 1 are denoted by the same referential symbols or numerals, and the redundant description thereof are omitted.

In such a case, electrode terminals 54*ai* (i=1 to n, is a positive integer) of the electrode terminal supporting body 14 are made of copper alloy by pressing, for example. Each of the electrode terminals 54*ai* includes: a disk-shaped head portion 54H fitted into one of the holes 14*ai* formed in a grid in the supporting body portion; and a cylindrical portion 54B connected to the head portion 54H.

The head portion 54H of each electrode terminal 54*ai* has a flat touching surface which touches on one of the conductive portions 16Ea of the aforementioned anisotropic conductive sheet 16 when the anisotropic conductive sheet 16 is placed on the electrode surface portion 14E of the electrode terminal supporting body 14. The flatness of the touching surface is set to about not more than ½ of the displacement of the conductive portion of the anisotropic conductive sheet. The diameter of the head portion 54H is set larger than the diameter of each conductive portion 16Ea of the aforementioned anisotropic conductive sheet 16. This allows each conductive portion 16Ea of the anisotropic conductive sheet 16 to be pressed against the touching surface without being misaligned, thus preventing the conductive portions 16Ea from being damaged.

On the central part of the outer periphery of the cylindrical portion 54B, annular protrusions 54*na* and 54*nb* are formed at a predetermined interval. The protrusions 54*na* and 54*nb* are pressed into and latched by the pores 14*di* (i=1 to n, is a positive integer) communicating with the holes 14*ai* of the later-described electrode terminal supporting body 14.

The lower end of the cylindrical portion 54B is a press-fit type. The lower end of the cylindrical portion 54B includes a slit 54*b* and is pressed into one of the plated through-holes 60*ai* of the printed wiring board 60.

Figure 3:
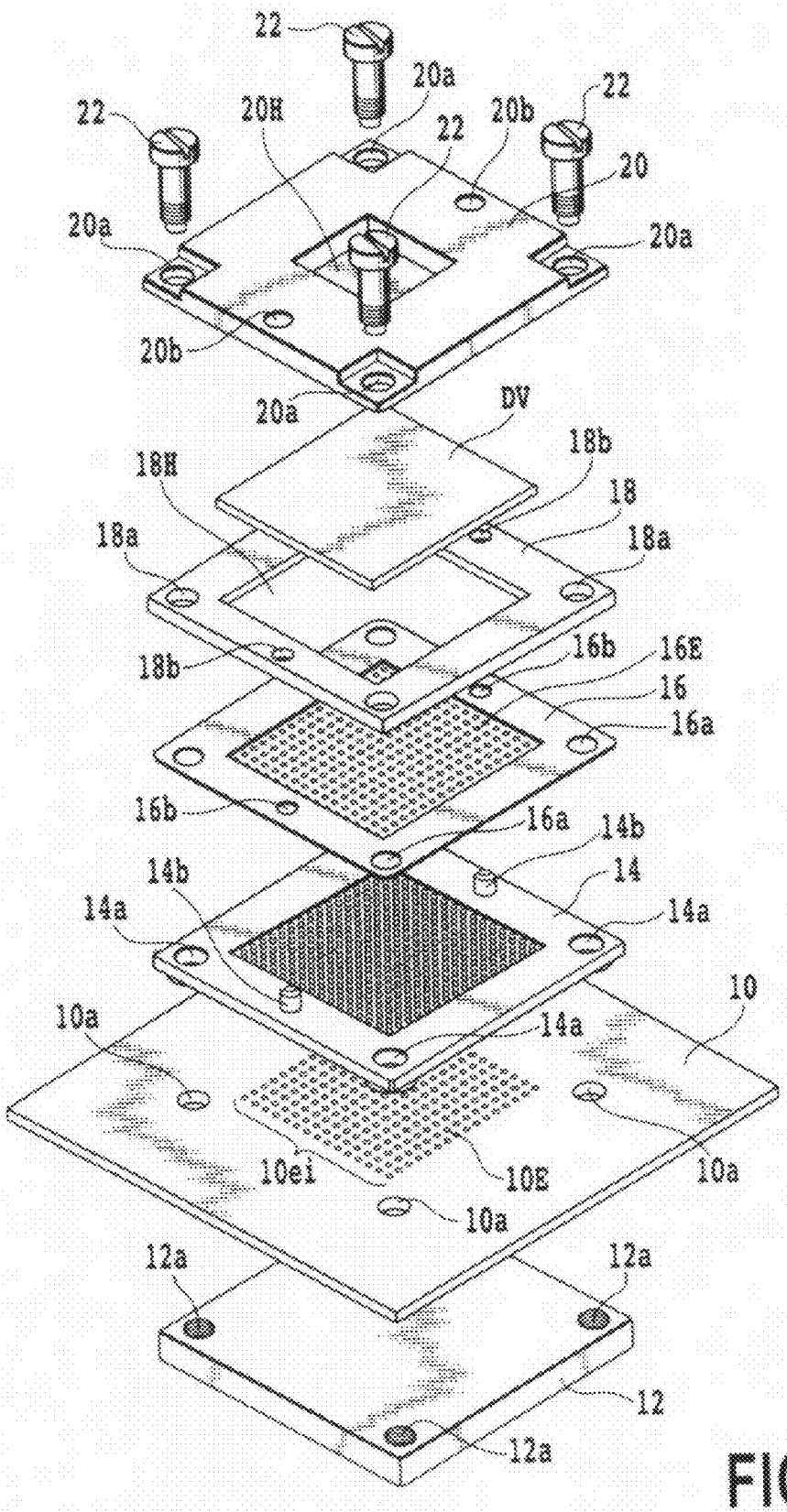
FIG. 3 is an exploded perspective view showing the constituent components of the embodiment shown in FIG. 2.
Figure 18:
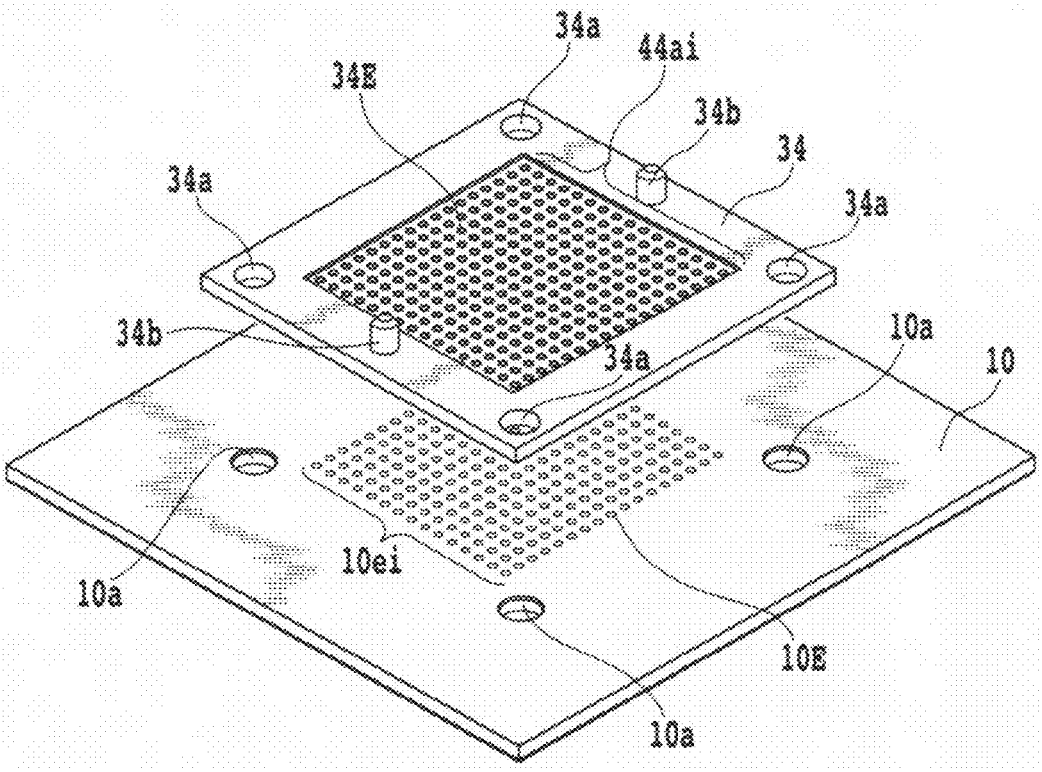
FIG. 18 is a perspective view showing yet another example of the electrode terminal supporting body and the electrode terminals used in the embodiment of the semiconductor device socket according to the present invention.

Furthermore, FIG. 18 shows still another example of the electrode terminal supporting body used in the embodiment of the substrate connecting connector according to the present invention. In FIG. 18, the same constituent components as those of the embodiment shown in FIG. 3 are denoted by the same referential symbols or numerals, and the redundant description thereof is omitted.

As enlarged in FIG. 18, an electrode terminal supporting body 34 includes an electrode surface portion 34E and a supporting body portion surrounding the supporting body portion 34E. The electrode terminal supporting body 34 includes, in the center thereof, a plurality of electrode terminals 44*ai* (i=1 to n, i is a positive integer) arranged in a grid.

Figure 20:
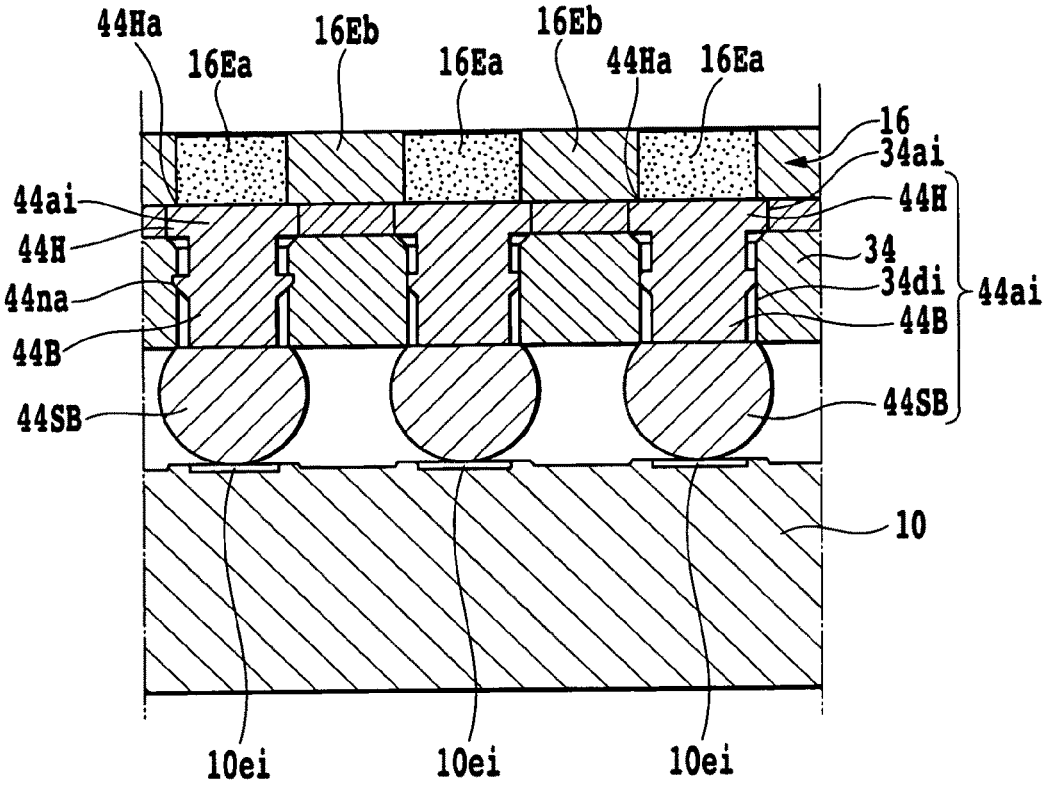
FIG. 20 is a partial enlarged cross-sectional view of a part of the example shown in FIG. 18.
Figure 21:
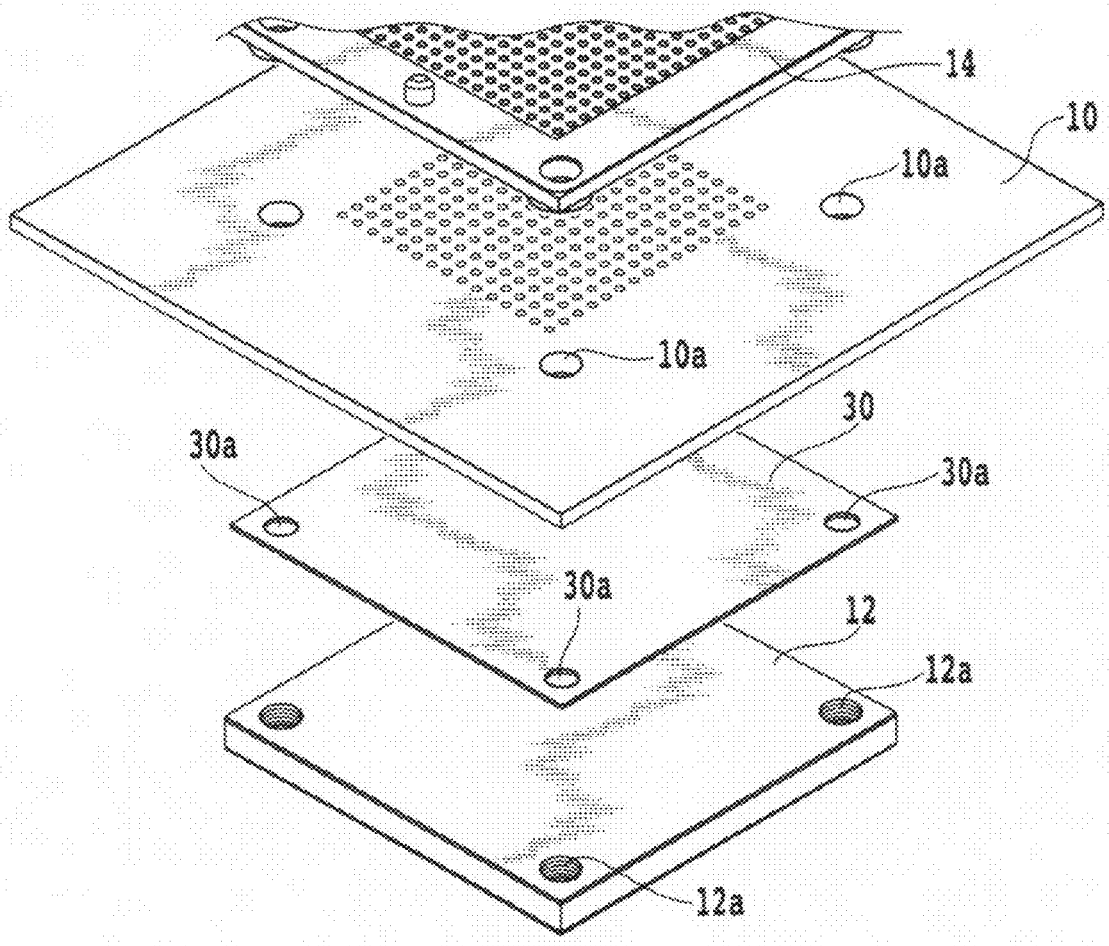
FIG. 21 is a perspective view showing an insulating sheet used in the embodiment of the semiconductor device socket according to the present invention together with the electrode terminal supporting body, a printed wiring board, and a stiffening plate.

The electrode terminals 44*ai* are made of, for example, copper alloy by pressing. As enlarged in FIG. 20, each of the electrode terminals 44*ai* includes a disk-shaped head portion 44H, a cylindrical portion 44B connected to the head portion 44H, and a solder ball 44SB. The head portion 44H is fitted in one of the holes 34*ai* (i=1 to n, i is a positive integer) formed in a grid in the supporting body portion.

The electrode terminals 44*ai* are arranged in a grid at predetermined intervals. The head portion 44H of each electrode terminal 44*ai* has a flat touching surface 44Ha which is configured to touch on one of the conductive portions 16Ea of the aforementioned anisotropic conductive sheet 16 when the anisotropic conductive sheet 16 is placed on the electrode surface portion 14E of the electrode terminal supporting body 14. The flatness of the touching surface is about not more than ½ of the displacement of the conductive portions of the anisotropic conductive sheet. The diameter of the head portion 44H is set larger than the diameter of each conductive portion 16Ea of the anisotropic conductive sheet 16. This allows each conductive portion 16Ea of the anisotropic conductive sheet 16 to be pressed against the touching surface 44Ha without being displaced from the touching surface 44Ha, thus preventing the conductive portion 16Ea from being damaged.

In the central part of the outer periphery of the cylindrical portion 44B, an annular protrusion 44*na* is formed. The protrusion 44*na* is pressed into one of pores 34*di* (i=1 to n, n is a positive integer) communicating with the holes 34*ai* of the electrode terminal supporting body 34 to be latched (see FIG. 20).

The solder ball 44SB welded to the lower end of the cylindrical portion 44B is soldered and fixed to one of the electrode pads 10*ei* of the printed wiring board 10 by reflowing. The solder ball 44SB of the electrode terminal 44*ai* of the electrode terminal supporting body 34 is welded to one of the electrode pads 10*ei* of the printed wiring board 10. At that time, even if the printed wiring board 10 is warped, the warpage of the printed wiring board 10 is suppressed by the rigidity of the electrode terminal supporting body 34 and the wettability of the solder ball 44SB.

The supporting body portion of the electrode terminal supporting body 34 is made of a resin material and is substantially shaped in a square having the same outside dimensions as those of the aforementioned anisotropic conductive sheet 16. The resin material may be, for example, glass epoxy resin similar to the material of the printed wiring board 10. In such a case, the electrode terminal supporting body 34 and the printed wiring board 10 have the same thermal expansion coefficient and do not distort to each other. Accordingly, the solder ball 44SB is prevented from suffering from cracks due to thermal expansion of the printed wiring board 10.

Figure 19:
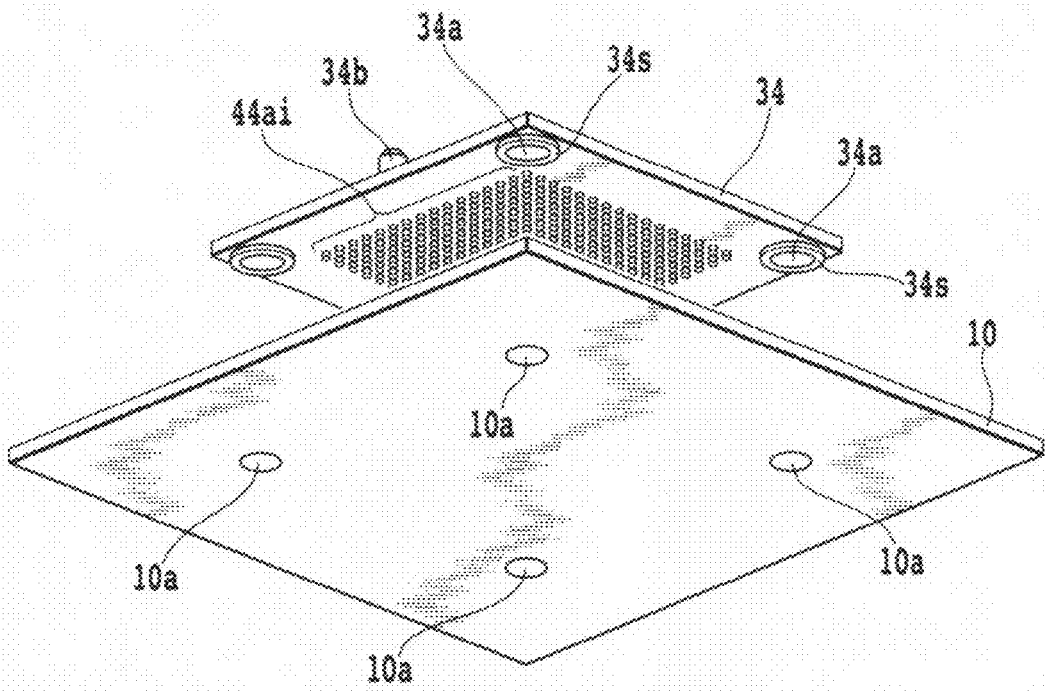
FIG. 19 is a perspective view being viewed as from the back side of the electrode terminal supporting body of the example shown in FIG. 18.

At corners of the rim of the supporting body portion surrounding the electrode surface portion 34E, the holes 34*a* are formed. The machine screws 22 are configured to be individually inserted through the holes 34*a*. Between the holes 34*a* provided on each of a pair of opposing sides of the rim, a positioning pin 34*b* is provided. Moreover, on the surface of the supporting body portion facing the printed wiring board 10, seating surfaces 34S are formed around the individual holes 34*a*. The seating surfaces 34S are configured to touch on the printed wiring board 10 (see FIG. 19). As enlarged in FIG. 20, therefore, a gap corresponding to the seating surface 34S is formed between the lower surface of the supporting body portion and the surface of the printed wiring board 10.

In an area where the electrode surface portion 34E is formed, the pores 34*di* communicating with the aforementioned holes 34*ai* are formed with their central axes coaxial with the respective holes 34*ai*. The diameter of each thin hole 34*di* is set smaller than the diameter of each hole 34*ai*. The head portion 44H of each electrode terminal 44*ai* is latched at the circumferential edge of the opening of the thin hole 34*di* in the hole 34*ai*. The pores 34*di* penetrate toward the printed wiring board 10.

The adjacent holes 34*ai* are separated with partition walls, and the adjacent pores 34*di* are also separated with portions connected to the partition walls.

In the aforementioned example, one of the surfaces of the second stiffening plate 12 directly touches on the rear surface of the printed wiring board 10. However, the present invention is not limited to this example. For example, an insulating sheet 30 is interposed between the rear surface of the printed wiring board 10 and the one of the surfaces of the second stiffening plate 12. The insulating sheet 30 includes holes 30*a* at the corners corresponding to the holes 10*a* of the printed wiring board 10 and the internal thread holes 12*a* of the second stiffening plate 12.

Figure 22:
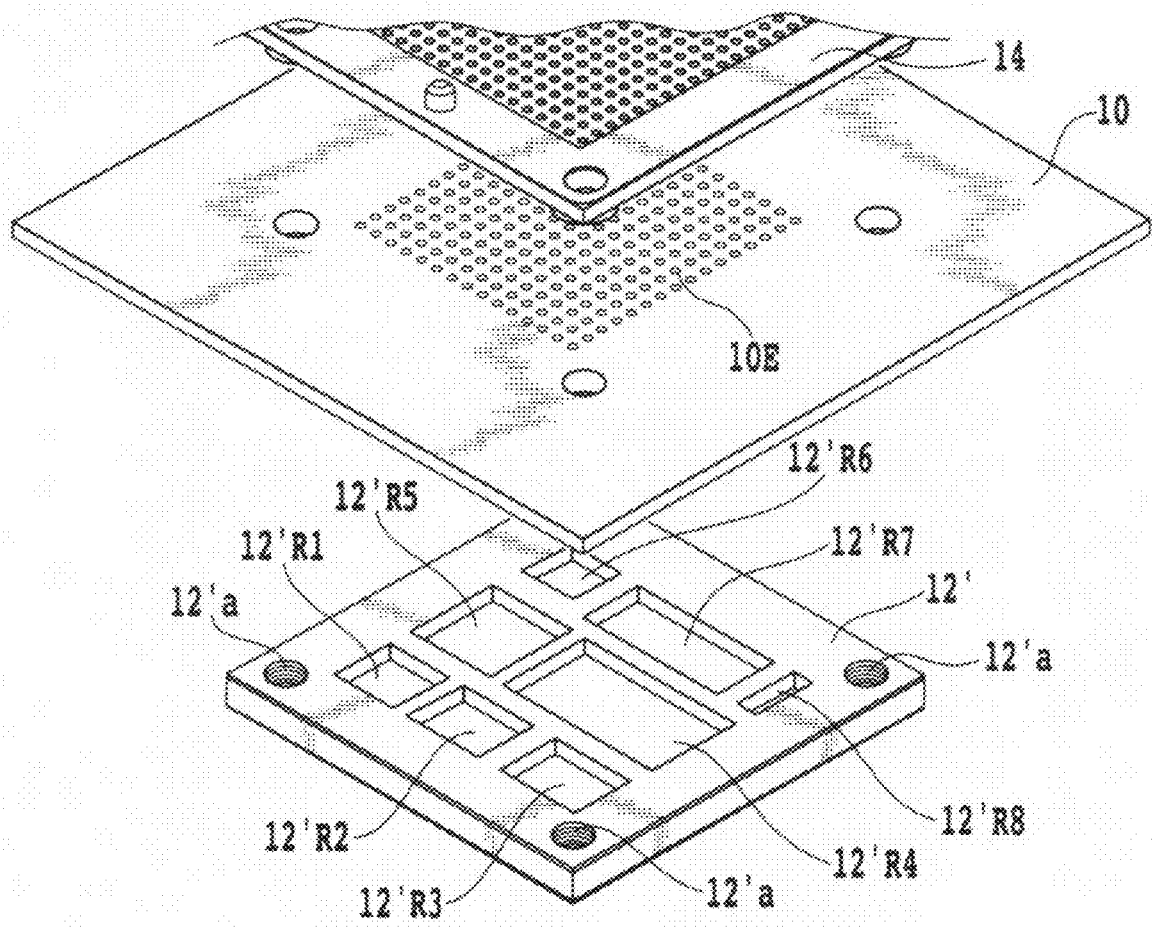
FIG. 22 is a perspective view showing another example of the stiffening plate used in the embodiment of the semiconductor device socket according to the present invention together with the electrode terminal supporting body and the printed wiring board.

Alternatively, for example as shown in FIG. 22, the second stiffening plate 12 may be replaced with a second stiffening plate 12' which includes recesses 12'R1 to 12'R8 in such a manner that a plurality of cavities are formed adjacent to each other between the second stiffening plate 12' and the rear surface of the printed wiring board 10. The recesses 12'R1 to 12'R8 are separated with partition walls. By including the recesses 12'R1 to 12', the second stiffening plate 12' can be attached even if some electronic parts are mounted on the rear surface of the printed wiring board 10. The second stiffening plate 12' includes internal thread holes 12'*a* at individual corners, and the machine screws 22 are configured to be screwed into the internal thread holes 12'*a*.

Figure 23:
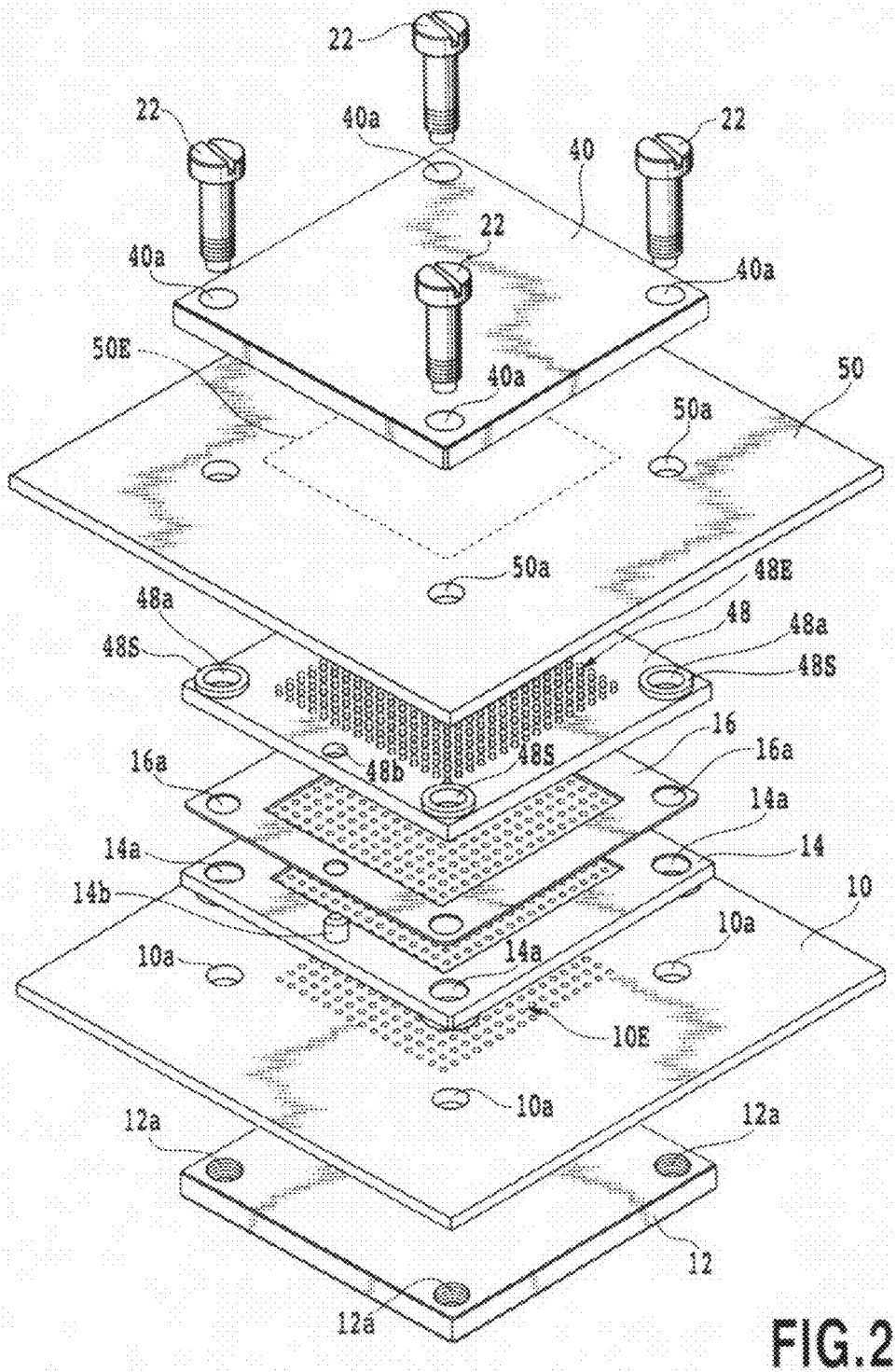
FIG. 23 is an exploded perspective view showing the constituent components of an embodiment of a board-to-board connector according to the present invention.
Figure 24:
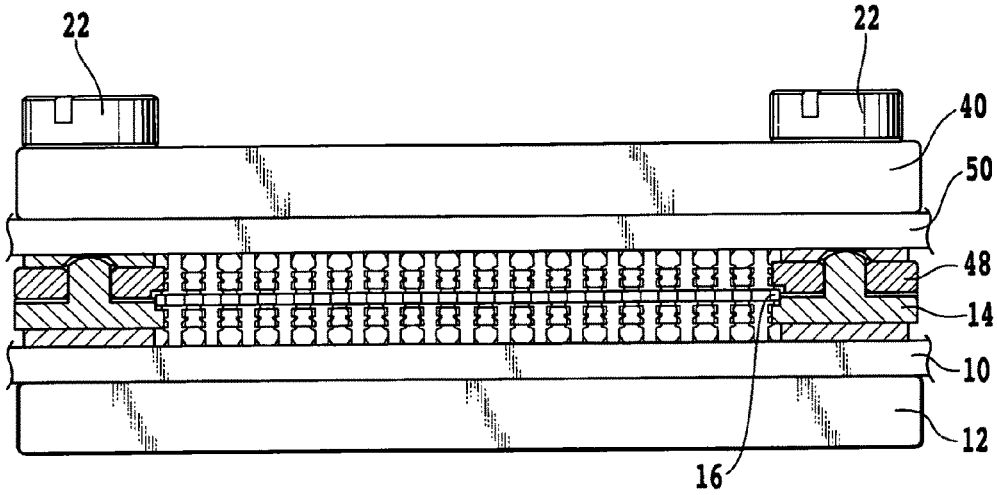
FIG. 24 is a partial cross-sectional view of the embodiment shown in FIG. 23.
Figure 25:
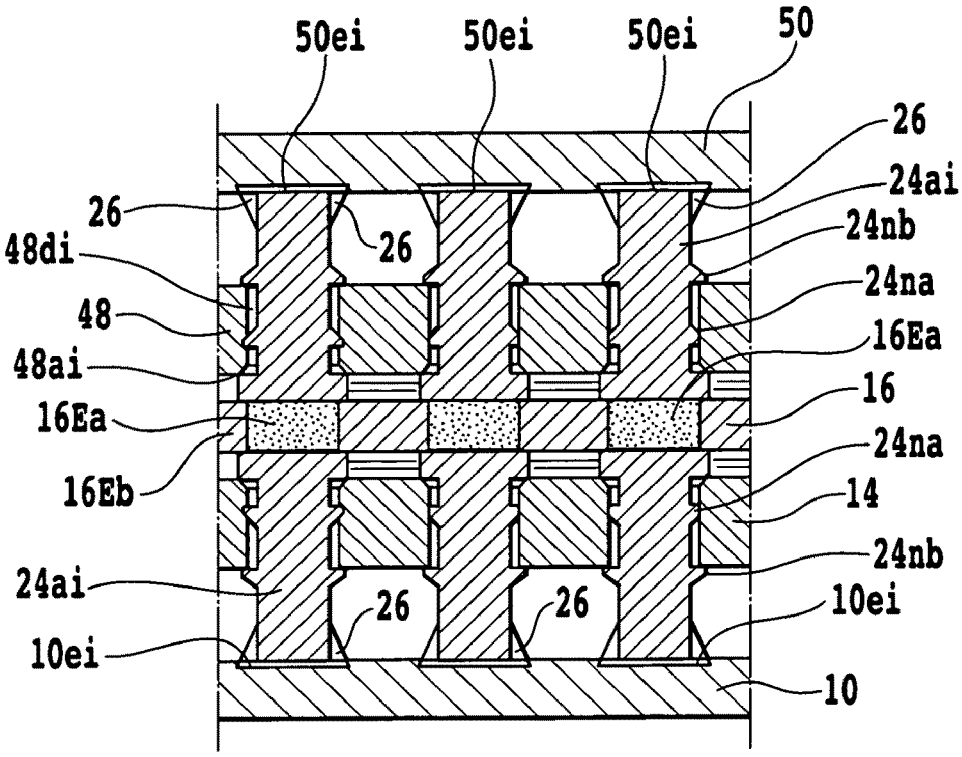
FIG. 25 is a partial enlarged cross-sectional view showing a part of the embodiment shown in FIG. 24.

FIG. 23 shows an appearance of an embodiment of a board-to-board connector to which the embodiment of the substrate connecting connector according to the present invention is applied. In FIGS. 23 to 25, the same constituent components as those of the embodiment shown in FIG. 3 are denoted by the same referential symbols or numerals, and the redundant description thereof is omitted.

In FIG. 23, the board-to-board connector is configured to electrically connect a printed wiring board 50 and the printed wiring board 10.

The board-to-board connector includes: the electrode terminal supporting body 14 provided on the printed wiring board 10 as a first electrode terminal supporting body; the anisotropic conductive sheet 16 positioned and placed to the electrode terminal supporting body 14; an electrode terminal supporting body 48 placed on the anisotropic conductive sheet 16 as a second electrode terminal supporting body; and first and second stiffening plate 40 and 12 sandwiching the anisotropic conductive sheet 16, the electrode terminal supporting body 14, the electrode terminal supporting body 48, the printed wiring board 10, and the printed wiring board 50 in cooperation with each other.

The printed wiring board 50 is made of, for example, glass epoxy resin and includes an electrode group 50E in substantially central part of one of the surfaces thereof. The electrode group 50E includes electrode pads 50*ei* (i=i to n, is a positive integer) formed in a grid corresponding to the positions of the aforementioned electrode terminals 24*ai*. Around the electrode group 50E, four holes 50*a* are formed corresponding to holes 40*a* of the later-described first stiffening plate 40. The machine screws 22 are configured to be inserted through the holes 40*a*.

As enlarged in FIG. 23, the electrode terminal supporting body 48 includes an electrode surface portion 48E in the central part thereof and a supporting body portion surrounding the electrode surface portion 48E. The electrode surface portion 48E includes the plurality of electrode terminals 24*ai* (i=1 to n, i is a positive integer) in a grid.

As enlarged in FIG. 25, each of the electrode terminals 24*ai* includes the annular protrusions 24*na* and 24*nb* at a predetermined interval in the central part of the outer periphery of the cylindrical portion 24B. The protrusions 24*na* and 24*nb* are pressed into pores 48*di* communicating with the respective holes 48*ai* of the electrode terminal supporting body 48 to be latched.

The lower end of each cylindrical portion 24B of the electrode terminal supporting body 48 is soldered and fixed to one of the electrode pads 50*ei* of the printed wiring board 50. As enlarged in FIG. 25, at the lower end of each cylindrical portion 24B, a solder fillet 26 is formed.

The supporting body portion of the electrode terminal supporting body 48 is made of a resin material and is shaped in a substantially square having the same outside dimensions as those of the aforementioned anisotropic conductive sheet 16. At individual corners in the rim of the supporting body portion surrounding the electrode surface portion 48E, holes 48*a* are formed as shown in FIG. 23. The machine screws 22 are configured to be inserted through the holes 48*a*. Moreover, in the surface of the electrode terminal supporting body 48 facing the printed wiring board 50, seating surfaces 48S are formed around the holes 48*a* and are configured to touch on the printed wiring board 50. This forms a gap corresponding to the height of the seating surfaces 48S between the surface of the printed wiring board 50 and a portion of the supporting body portion facing the printed wiring board 50, as enlarged in FIG. 25. Moreover, holes 48*b* are formed between the holes 48*a* formed on each of a pair of opposing sides of the supporting body portion. The positioning pins 14*b* of the electrode terminal supporting body 14 are configured to fit in the holes 48*b*.

In the area where the electrode surface portion 48E is formed, the pores 48*di* communicating with the respective holes 48*ai* are formed with their central axes coaxial with the holes 48*ai*. The diameter of each thin hole 48*di* is set smaller than the diameter of each hole 48*ai*. The head portion 24H of each electrode terminal 24*ai* is latched at the circumferential edge of the opening of one of the pores 48*di* in the hole 48*ai*. The pores 48*di* penetrate toward the printed wiring board 50.

The adjacent holes 48*ai* are separated by partition walls, and the adjacent pores 48*di* are separated by portions continuing to the partition walls.

The first stiffening plate 40 is formed into a square having the same outside dimensions as those of the electrode terminal supporting body 48. The first stiffening plate 40 includes flat surfaces opposed to each other and holes 40*a* at individual corners thereof. The machine screws 22 are configured to be inserted through the holes 40*a*.

In such a configuration, the first stiffening plate 40 is fastened to the printed wiring board 50, electrode terminal supporting body 48, anisotropic conductive sheet 16, electrode terminal supporting body 14, printed wiring board 10, and second stiffening plate 12 by the four machine screws 22. At that time, by the pressing surface of the first stiffening plate 40, the printed wiring board 50 and the electrode terminals 24*ai* of the electrode terminal supporting body 48 are pressed against an end surface of each conductive portion 16Ea of the anisotropic conductive sheet 16 by a predetermined amount. The other end surface of each conductive portion 16Ea of the anisotropic conductive sheet 16 therefore comes into contact with one of the electrode terminals 24*ai* of the electrode terminal supporting body 14. Consequently, the electrode pads 50*ei* of the printed wiring board 50 are electrically connected to the respective electrode pads 10*ei* of the printed wiring board 50.

Figure 26:
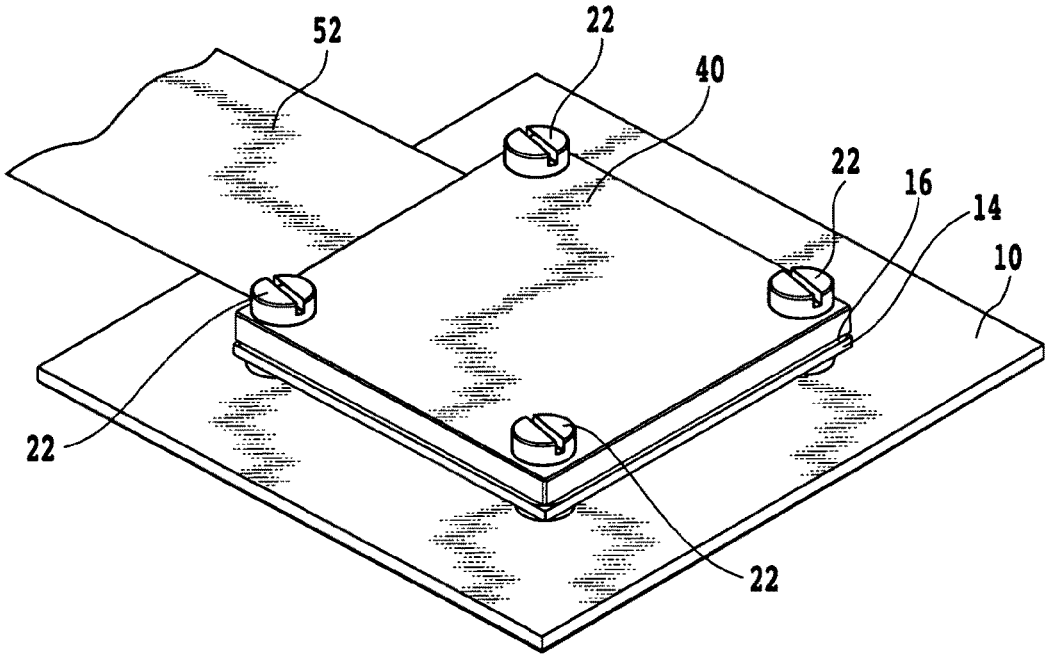
FIG. 26 is a perspective view showing an appearance of an embodiment of a cable connector according to the present invention.
Figure 27:
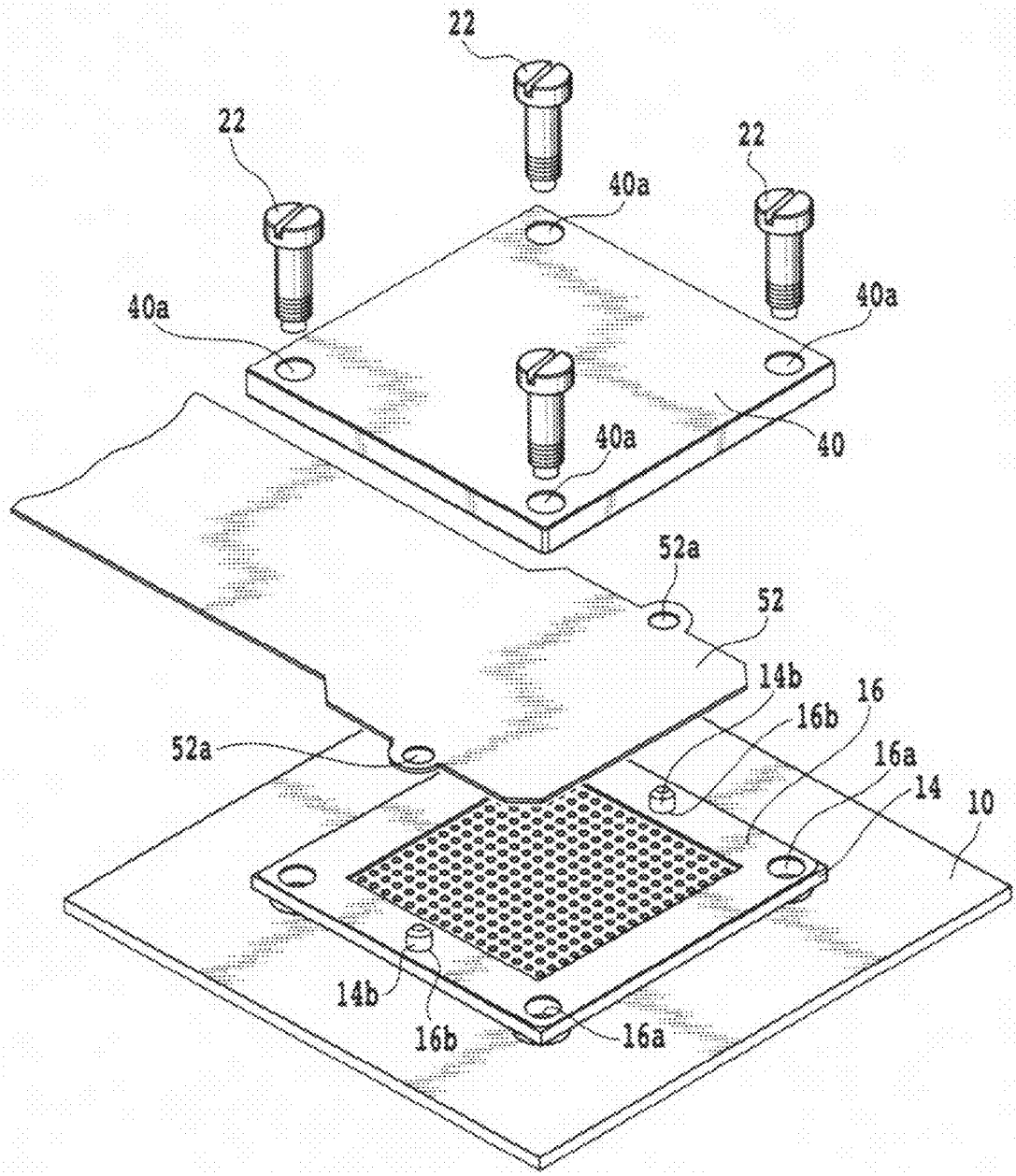
FIG. 27 is an exploded perspective view showing the constituent components of the embodiment shown in FIG. 26.

FIG. 26 shows an appearance of an example of a cable connector to which the embodiment of the substrate connecting connector according to the present invention is applied. In FIGS. 26 and 27, the same constituent components as those of the embodiment shown in FIGS. 3 and 23 are denoted by the same referential symbols or numerals, and the redundant description thereof is omitted.

In FIG. 26, the cable connector is configured to electrically connect a flexible wiring board 52 and the aforementioned printed wiring board 10. The cable connector includes: the electrode terminal supporting body 14 soldered and fixed to the printed wiring board 10; the anisotropic conductive sheet 16 placed on the electrode terminal supporting body 14; and the first stiffening plate 40 and a second stiffening plate (not shown) pressing electrode pads (not shown) of the later-described flexible wiring board 52 against the anisotropic conductive sheet 16 to sandwich the flexible wiring board 52 in cooperation with each other.

The flexible wiring board 52 is referred to as, for example, YFLEX (registered trademark) and has a structure in which a plurality of conductive layers covered with protecting layers are formed on an insulating base material. The insulating base material has a thickness of about 50 μm, for example, and is made of a material properly selected from a group consisting of liquid crystal polymer (LCP), polyimide (PI), polyethylene terephthalate (PET), and polycarbonate (PC). Each conductive layer is composed of an about 12 μm thick layer of copper alloy, for example. Each protecting layer is composed of a thermosetting resist layer or polyimide film, for example. On opposing sides of the connected end of the flexible wiring board 52, holes 52*a* are formed. The positioning pins 14*b* of the electrode terminal supporting body 14 are configured to be fitted in the holes 52*a*.

In the surface of the end of the flexible wiring board 52 (the surface facing the anisotropic conductive sheet 16), for example, a group of electrode pads (not shown) arranged in a grid as terminal portions corresponding to the conductive portions of the anisotropic conductive sheet 16 is formed. The group of electrode pads is electrically connected to the conductive layers within the flexible wiring board 52.

Figure 28:
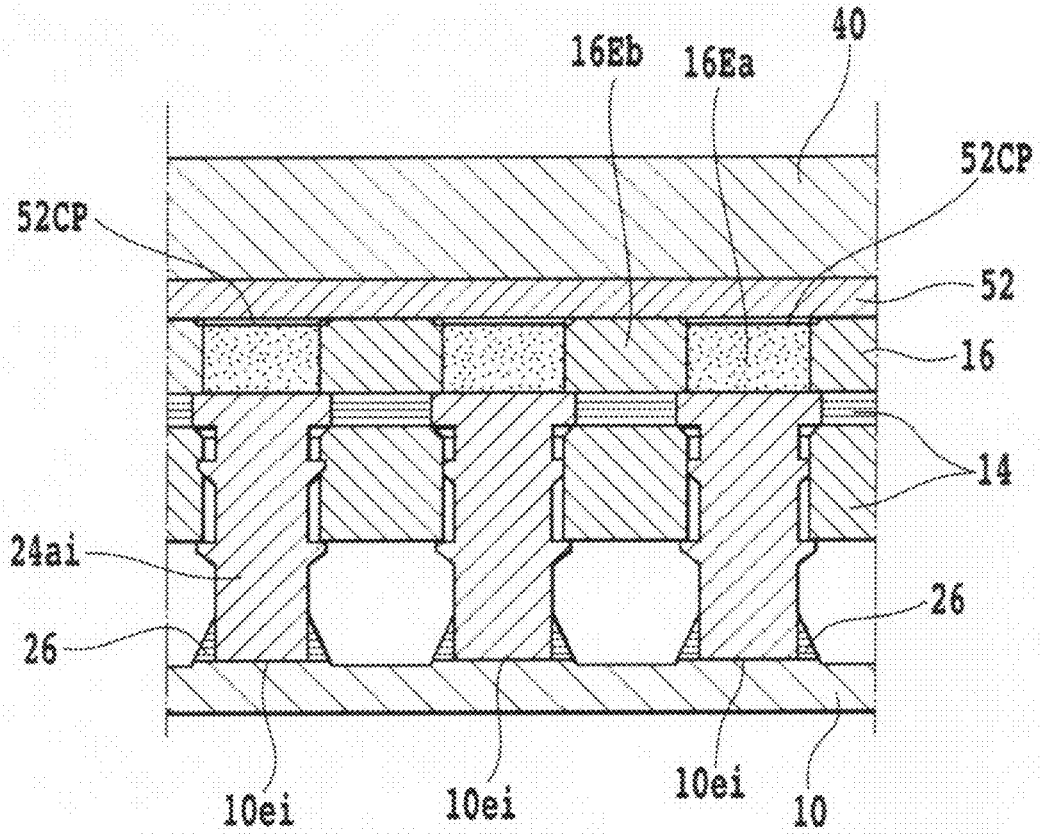
FIG. 28 is a partial enlarged cross-sectional view showing a part of the embodiment shown in FIG. 26.

In such a configuration, the first stiffening plate 40 is fastened to the aforementioned flexible wiring board 52, the anisotropic conductive sheet 16, the electrode terminal supporting body 14, the printed wiring board 10, and the second stiffening plate with the four machine screws 22. At that time, as enlarged in FIG. 28, by the pressing surface of the first stiffening plate 40, each of electrode pads 52*cp* of the flexible wiring board 52 is pressed against an end surface of one of the conductive portions 16Ea of the anisotropic conductive sheet 16 by a predetermined amount. The other end surface of each conductive portion 16Ea of the anisotropic conductive sheet 16 then comes into contact with one of the electrode terminals 24*ai* of the electrode terminal supporting body 14. The electrode pads 52*cp* of the flexible wiring board 52 are thus electrically connected to the respective electrode pads 10*ei* of the printed wiring board 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A substrate connecting connector comprising:

an electrode terminal supporting body which is provided on a printed wiring board electrically connected to an electronic device and has a plurality of electrode terminals fixed to respective conductive layers of the printed wiring board;

an anisotropic conductive sheet which is positioned on the electrode terminal supporting body and has a plurality of conductive portions formed corresponding to the electrode terminals;

a pressing member for pressing at least either one of the plurality of conductive portions of the anisotropic conductive sheet or the electrode terminals against the other while holding one; and a fixture which fixes the pressing member to the printed wiring board between which the electronic device, the electrode terminal supporting body, and the anisotropic conductive sheet are interposed, wherein a diameter of each head portions of the electrode terminals brought into contact with the conductive portions of the anisotropic conductive sheet is set to have a diameter larger than a diameter of each conductive portion of the anisotropic conductive sheet.

2. The substrate connecting connector according to claim 1, wherein touching surfaces of the head portions of the electrode terminals brought into contact with the conductive portions of the anisotropic conductive sheet are on the common plane with an electrode surface portion of the electrode terminal supporting body.

3. The substrate connecting connector according to claim 1, wherein flatness of the common plane including the touching surfaces of the plurality of electrode terminals brought into contact with the conductive portions is set larger than zero and not larger than ½ of a displacement of the anisotropic conductive sheet.

4. The substrate connecting connector according to claim 1, wherein positioning pins of the electrode terminal supporting body configured to position the conductive portions of the anisotropic conductive sheet with respect to the electrode terminals are fitted into holes of the anisotropic conductive sheet.

5. The substrate connecting connector according to claim 2, wherein flatness of the common plane including the touching surfaces of the plurality of electrode terminals brought into contact with the conductive portions is set larger than zero and not larger than ½ of a displacement of the anisotropic conductive sheet.

6. A semiconductor device socket comprising:

an electrode terminal supporting body which is provided on a printed wiring board electrically connected to a semiconductor device and has a plurality of electrode terminals fixed to respective conductive layers of the printed wiring board;

an anisotropic conductive sheet which is positioned on the electrode terminal supporting body and has a plurality of conductive portions formed corresponding to the electrode terminals;

a pressing member for pressing at least either one of the plurality of conductive portions of the anisotropic conductive sheet or the electrode terminals against the other while holding one; and a fixture which fixes the pressing member to the printed wiring board between which the semiconductor device, the electrode terminal supporting body, and the anisotropic conductive sheet are interposed, wherein a diameter of each head portions of the electrode terminals brought into contact with the conductive portions of the anisotropic conductive sheet is set to have a diameter larger than a diameter of each conductive portion of the anisotropic conductive sheet.

7. A cable connector, comprising:

an electrode terminal supporting body which is provided on a printed wiring board electrically connected to an end of a cable and has a plurality of electrode terminals fixed to respective conductive layers of the printed wiring board;

an anisotropic conductive sheet which is positioned on the electrode terminal supporting body and has a plurality of conductive portions formed corresponding to the electrode terminals;

a pressing member for pressing at least either one of the plurality of conductive portions of the anisotropic conductive sheet or the electrode terminals against the other while holding one; and a fixture which fixes the pressing member to the printed wiring board between which the end of the cable, the electrode terminal supporting body, and the anisotropic conductive sheet are interposed, wherein a diameter of each head portions of the electrode terminals brought into contact with the conductive portions of the anisotropic conductive sheet is set to have a diameter larger than a diameter of each conductive portion of the anisotropic conductive sheet.

8. A board-to-board connector, comprising:

a first electrode terminal supporting body which is provided on a first printed wiring board and has a plurality of electrode terminals fixed to respective conductive layers of the first printed wiring board;

a second electrode terminal supporting body which is provided on a second printed wiring board placed opposed to the first printed wiring board and has a plurality of electrode terminals fixed to respective conductive layers of the second printed wiring board;

an anisotropic conductive sheet which is positioned between the first and second electrode terminal supporting bodies and has a plurality of conductive portions formed corresponding to the electrode terminals;

a pair of pressing members for pressing at least either one of the plurality of conductive portions of the anisotropic conductive sheet or the electrode terminals against the other while pressing one; and a fixture which fixes the pair of pressing members to the first and second printed wiring boards between which the first and second printed wiring boards, the first and second electrode terminal supporting bodies, and the anisotropic conductive sheet are interposed, wherein a diameter of each head portions of the electrode terminals brought into contact with the conductive portions of the anisotropic conductive sheet is set to have a diameter larger than a diameter of each conductive portion of the anisotropic conductive sheet.

* * * * *